US008534235B2

(12) United States Patent
Chandler

(10) Patent No.: US 8,534,235 B2
(45) Date of Patent: Sep. 17, 2013

(54) OIL-FIRED FRAC WATER HEATER

(76) Inventor: Ronald L. Chandler, Wichita Falls, TX (US)

( * ) Notice: Subject to any disclaimer, the term of this patent is extended or adjusted under 35 U.S.C. 154(b) by 850 days.

(21) Appl. No.: 12/352,505

(22) Filed: Jan. 12, 2009

(65) Prior Publication Data

US 2010/0000508 A1 Jan. 7, 2010

Related U.S. Application Data

(60) Provisional application No. 61/078,734, filed on Jul. 7, 2008.

(51) Int. Cl.
*F24H 3/06* (2006.01)
*F28D 15/00* (2006.01)

(52) U.S. Cl.
USPC ..... 122/276; 237/19; 126/116 R; 165/104.34

(58) Field of Classification Search
USPC ..... 122/DIG. 10; 237/19; 126/116 R; 165/104.34; 236/26 R
See application file for complete search history.

(56) References Cited

U.S. PATENT DOCUMENTS

| | | | | | |
|---|---|---|---|---|---|
| 235,124 | A | * | 12/1880 | Brott | 122/276 |
| 250,642 | A | * | 12/1881 | Brott | 122/276 |
| 1,747,158 | A | * | 2/1930 | Callahan | 454/265 |
| 1,870,931 | A | * | 8/1932 | Staples | 236/26 R |
| 1,949,471 | A | * | 3/1934 | Hildebrand, Jr. et al. | 122/DIG. 10 |
| 1,980,301 | A | * | 11/1934 | Stewart | 122/DIG. 10 |
| 2,000,270 | A | * | 5/1935 | Andrews et al. | 236/26 R |
| 2,137,960 | A | * | 11/1938 | Vidalie | 239/214.21 |
| 2,201,622 | A | * | 5/1940 | La Mont | 122/235.14 |
| 2,286,719 | A | * | 6/1942 | Demuth | 126/116 R |
| 2,309,356 | A | * | 1/1943 | Peterson | 237/2 R |
| 2,348,099 | A | * | 5/1944 | Throckmorton | 122/276 |
| 2,387,883 | A | * | 10/1945 | Dake | 122/DIG. 10 |
| 2,410,353 | A | * | 10/1946 | McCollum | 126/116 R |
| 2,410,900 | A | * | 11/1946 | Radbill | 122/DIG. 10 |
| 2,572,317 | A | * | 10/1951 | Chausse | 122/DIG. 10 |

(Continued)

FOREIGN PATENT DOCUMENTS

JP 08110002 A * 4/1996

OTHER PUBLICATIONS

Takemura, JP 08110002A English machine translation, Apr. 1996.*

(Continued)

*Primary Examiner* — Kang Hu
*Assistant Examiner* — Phillip E Decker
(74) *Attorney, Agent, or Firm* — Jeffrey G. Degenfelder; Carstens & Cahoon, LLP

(57) ABSTRACT

The present invention overcomes many of the disadvantages of prior art mobile oil field heat exchange systems by providing an oil-fired heat exchange system. The present invention is a self-contained unit which is easily transported to remote locations. The present invention includes a single-pass tubular coil heat exchanger contained within a closed-bottom firebox having a forced-air combustion and cooling system. The rig also includes integral fuel tanks, hydraulic and pneumatic systems for operating the rig at remote operations in all weather environments. In a preferred embodiment, the oil-fired heat exchanger system is used to heat water on-the-fly (i.e., directly from the supply source to the well head) to complete hydraulic fracturing operations. The present invention also includes systems for regulating and adjusting the fuel/air mixture within the firebox to maximize the combustion efficiency. The system includes a novel hood opening mechanism attached to the exhaust stack of the firebox.

22 Claims, 12 Drawing Sheets

(56) References Cited

U.S. PATENT DOCUMENTS

| | | | | | |
|---|---|---|---|---|---|
| 2,586,998 | A | * | 2/1952 | Schlenz | 122/DIG. 10 |
| 2,629,366 | A | * | 2/1953 | Seevers | 122/DIG. 10 |
| 2,631,656 | A | * | 3/1953 | Siemon | 431/61 |
| 2,699,155 | A | * | 1/1955 | Olson et al. | 122/274 |
| 2,993,481 | A | * | 7/1961 | Svensson | 122/406.1 |
| 3,051,146 | A | * | 8/1962 | Clarkson et al. | 122/249 |
| 3,254,634 | A | * | 6/1966 | Vorkauf | 122/235.11 |
| 3,291,182 | A | * | 12/1966 | Dow, Jr. et al. | 431/165 |
| 3,401,673 | A | * | 9/1968 | Key, Jr. | 122/250 R |
| 3,454,095 | A | | 7/1969 | Messenger et al. | |
| 3,498,063 | A | * | 3/1970 | Graber et al. | 60/225 |
| 3,693,719 | A | | 9/1972 | Sample, Jr. et al. | |
| 3,924,683 | A | | 12/1975 | George et al. | |
| 4,074,624 | A | * | 2/1978 | Biornstad et al. | 100/35 |
| 4,165,613 | A | * | 8/1979 | Bernhoft et al. | 60/420 |
| 4,174,951 | A | * | 11/1979 | Bloom | 432/133 |
| 4,228,767 | A | * | 10/1980 | Smith et al. | 122/DIG. 10 |
| 4,231,222 | A | * | 11/1980 | Fenton | 60/524 |
| 4,348,171 | A | * | 9/1982 | Issenmann | 431/202 |
| 4,487,571 | A | * | 12/1984 | Robertson et al. | 431/208 |
| 4,552,097 | A | | 11/1985 | Jarmuzewski | |
| 4,668,408 | A | | 5/1987 | McClaflin et al. | |
| 4,680,006 | A | * | 7/1987 | Fisher | 431/265 |
| 4,706,749 | A | | 11/1987 | Hayes et al. | |
| 4,779,795 | A | * | 10/1988 | Winmill | 237/19 |
| 4,813,482 | A | | 3/1989 | Walton | |
| 5,067,894 | A | * | 11/1991 | Bender | 431/208 |
| 5,082,055 | A | | 1/1992 | Hemsath | |
| 5,120,935 | A | | 6/1992 | Nenniger | |
| 5,244,381 | A | * | 9/1993 | Cahlik | 126/116 R |
| 5,247,994 | A | | 9/1993 | Nenniger | |
| 5,400,430 | A | | 3/1995 | Nenniger | |
| 5,623,576 | A | | 4/1997 | Deans | |
| 5,638,773 | A | * | 6/1997 | Brady et al. | 122/248 |
| 5,641,022 | A | | 6/1997 | King | |
| 5,656,136 | A | | 8/1997 | Gayaut et al. | |
| 5,795,402 | A | | 8/1998 | Hargett, Sr. et al. | |
| 5,893,341 | A | * | 4/1999 | Cox | 122/DIG. 10 |
| 5,903,060 | A | * | 5/1999 | Norton | 237/8 D |
| 5,988,280 | A | | 11/1999 | Crawford et al. | |
| 6,073,695 | A | | 6/2000 | Crawford et al. | |
| 6,129,148 | A | | 10/2000 | Meeks | |
| 6,143,709 | A | | 11/2000 | Carey | |
| 6,460,536 | B2 | * | 10/2002 | Story et al. | 126/271.2 B |
| 6,470,836 | B1 | | 10/2002 | Manley et al. | |
| 6,663,381 | B2 | * | 12/2003 | Manohar | 126/116 R |
| 6,702,022 | B2 | | 3/2004 | Kattsyn et al. | |
| 6,758,275 | B2 | | 7/2004 | Martin | |
| 6,769,488 | B2 | | 8/2004 | Stone | |
| 6,989,095 | B2 | | 1/2006 | Melton et al. | |
| 6,990,930 | B2 | | 1/2006 | Sarkar | |
| 7,069,993 | B2 | | 7/2006 | Hill | |
| 7,150,320 | B2 | | 12/2006 | Heins | |
| 7,296,627 | B2 | | 11/2007 | Dyer | |
| 7,306,042 | B2 | | 12/2007 | Bansal et al. | |
| 7,363,979 | B2 | | 4/2008 | Hill | |
| 7,402,039 | B1 | | 7/2008 | McElroy | |
| 2006/0060418 | A1 | * | 3/2006 | de Borchgrave et al. | 181/229 |

OTHER PUBLICATIONS

Definition of "Helical", Oxford English Dictionary, 2013, Oxford University Press.*

"Improved water-frac increases production", Jay A. Rushing et al.; E&P Global Exploration & Production News, Technology Updates, Analysis; http://www.eandp.info.

* cited by examiner

OIL-FIRED FRAC WATER HEATER

CROSS-REFERENCE TO RELATED APPLICATION

This application claims the benefit of and priority to a U.S. Provisional Patent Application No. 61/078,734 filed Jul. 7, 2008. the technical disclosure of which is hereby incorporated herein by reference.

BACKGROUND OF THE INVENTION

1. Technical Field

The present invention relates to an apparatus and method for heating a water or petroleum based fluid for injection into an oil or gas well or into a pipeline system.

2. Description of the Related Art

It is common in the oil and gas industry to treat oil and gas wells and pipelines with heated fluids such as water and oil. For example, one such application commonly known as a hydraulic fracturing job or "frac" job, involves injecting large quantities of a heated aqueous solution into a subterranean formation to hydraulically fracture it. Such frac jobs are typically used to initiate production in low-permeability reservoirs and/or re-stimulate production in older producing wells. Water is typically heated to a specific temperature range to prevent expansion or contraction of the downhole well casing. The heated water is typically combined with a mixture of chemical additives (e.g., friction reducer polymers which reduce the viscosity of the water and improve its flowability so that it's easier to pump down the well), proppants (e.g., a special grade of light sand), and a cross-linked guar gel that helps to carry the sand down into the well. This fraccing fluid is then injected into a well hole at a high flow rate and pressure to break up the formation, increasing the permeability of the rock and helping the gas or oil flow toward the surface. As the fraccing solution cracks the rock formation, it deposits the sand. As the fractures try to close, the sand keeps them propped open. Frac jobs are typically performed once when a well is newly drilled, and again after a couple of years when the production flow rate begins to decline Another application, commonly referred to as a "hot oil treatment", involves treating tubulars of an oil and gas well or pipeline by Hushing them with a heated solution to remove build up of paraffin along the tubulars that precipitate from the oil stream that is normally pumped therethrough.

Frac jobs and hot oil treatments are typically performed at the remote well sites and usually require less than a week to complete. Consequently, the construction of a permanent heating facility at the well site is not cost effective. Instead, portable heat exchangers, which are capable of transport to remote well sites via improved and unimproved roads, are commonly used.

In the past, such portable heat exchangers have typically employed gas-fired heat sources using a liquefied petroleum gas (LPG) such as propane to heat treatment fluids at remote well sites. Such gas-fired heater units typically include a tubular coil heat exchanger configured above one or more open flame gas burners in an open-ended firebox housing. The tubular coil heat exchanger typically comprises a fluid inlet in communication, with a plurality of interconnected tubes, which in turn communicate with a fluid outlet. The plurality of tubes are typically arranged in a stacked configuration of planar rows, wherein each tube in a row is aligned in parallel with the other tubes. The outlet of each tube is connected in series to the inlet of an adjacent tube in the row by means of a curved tube or return bend. Similarly, each planar row is connected to the adjacent rows above and below by connecting the outlet of the outermost tube in one row with the inlet of the outermost tube in another row by means of a curved tube or return bend.

The one or more gas burners are typically positioned below the tubular coil heat exchanger so as to project a vertical flame up and through the heat exchanger. The gas burners are supplied with gas fuel from a nearby gas storage tank (e.g., a propane tank). Ambient air is also supplied to the burners via the opened-ended bottom of the firebox housing. The hot flue gasses generated from the burning of the LPG rise up and through the tubular coil heat exchanger within the firebox housing and exhaust via a vent at the top of the firebox housing.

While gas-fired heat sources are adequate for performing many oil field servicing tasks, they exhibit a number of inherent drawbacks. These inherent limitations significantly impact their effectiveness in performing certain heating operations at remote oil field work sites. For example, frac jobs typically require the production of massive volumes of heated water. While gas-fired heat sources are certainly capable of heating fluids such as water, they are poorly suited to heating in a timely manner large volumes of continuously flowing water in many commonly occurring climactic and atmospheric conditions. Moreover, the logistics involved in conducting such heating operations at remote work sites negatively impacts the cost efficiencies of such a system.

For example, LPG (e.g., propane gas) has a relatively low energy content and density when compared to other fuel options. For example, diesel fuel when properly combusted typically releases about 138,700 British thermal units (BTU) per US gallon, while propane typically releases only about 91,600 BTU per liquid gallon, or over 33% less. Thus, gas-fired heating units often lack sufficient heating capacity to produce sufficient quantities of heated water rapidly enough for the required operation to be completed. Consequently, in order to provide sufficient quantities of heated water on a timely basis for a typical frac job, the treatment water must often be preheated and stockpiled in numerous frac water holding tanks. These holding tanks range in size up to 500 bbl (i.e., approximately 21,000 gallons). It is not unusual for a typical frac job to require 10 or even 20 frac water holding tanks at the remote work site. The preheated water is typically overheated so as to allow for cooling while waiting to be injected into the well. Oftentimes, the preheated treatment water must be reheated just prior to injection into the well head. Needless to say, the logistics involved with providing additional holding tanks at the remote work site and the additional costs incurred in overheating or reheating the supply water negatively impacts the efficiency of the overall operation.

While the technique of overheating and stockpiling supply water can ameliorate some the shortcomings in the heating capacity of gas-fired heat sources, in certain circumstances (e.g., severely cold weather or high altitude) it is inadequate. This is due to a number of reasons. First, the temperature change requirement for the system is simply greater in colder weather. That is, in colder weather the intake water supplied to the gas-fired heating unit is colder while the required injection temperature remains essentially the same. Thus, it takes longer for the gas-fired heating unit to preheat the supply water. The problem is further compounded by the fact that the stockpiled preheated water cools more rapidly in colder weather. Moreover, at higher altitudes there is less oxygen in the ambient atmosphere for combustion in the gas burner. Thus, at higher altitudes the heating capacity of gas-fired heat sources is further reduced.

In addition, propane gas requires large and heavy high-pressure fuel tanks for its transport to remote sites. The size of such high-pressure fuel tanks is, of course, limited by the size of existing roads. Thus, a typical frac job may require the transport of multiple large high-pressure fuel tanks to a remote site to ensure an adequate supply of fuel to complete the operation.

Furthermore, there are several safety concerns which must be taken into consideration when using gas-fired heat sources. As mentioned previously, current gas-fired heat exchangers typically use an open flame burner, i.e., a burner which is open to the ambient atmosphere. The fire boxes of such heat exchanger are typically elevated above the ground and opened on the bottom. The gas-fired burners are typically positioned near the open bottom of the firebox and directly below the heat exchange tubing. The gas-fired burners draw ambient air as necessary to assist in the combustion of the propane gas. While simple and efficient in providing air for combustion, open flame burners present a number of safety concerns. An open flame at the well site poses a substantial risk of explosion and uncontrolled tire, which can destroy the investment in the rig and injure or even cost the lives of the well operators. Moreover, open flame burners are particularly susceptible to erratic burning or complete blow-out in gusty wind conditions. Current U.S. government safety regulations provide that the open flame heating of the treatment fluids cannot take place within the immediate vicinity of the well.

While safety concerns are of overriding importance, compliance with the no open-flame regulations requires additional time and expense to conduct heated fluid well treatments. Thus, there has been a long felt need for a safer and more efficient apparatus and method of heating a treatment fluid for injecting into the tubulars of oil and gas wells and pipelines without using an open flame heat source in the vicinity of the treatment location.

SUMMARY OF THE INVENTION

The present invention overcomes many of the disadvantages of prior art mobile oil field heat exchange systems by providing an oil-fired heat exchange system. The present invention is a self-contained unit which is easily transported to remote locations. In one embodiment, the present invention is disposed on a trailer rig and includes a closed-bottom firebox having a forced-air combustion and cooling system. The rig also includes integral fuel tanks, hydraulic and pneumatic systems for operating the rig at remote operations in all weather environments. In a preferred embodiment, the oil-fired heat exchanger system is used to heat water on-the-fly (i.e., directly from the supply source to the well head) to complete a hydraulic fracturing operation.

The present invention comprises a closed firebox that includes a novel heat exchanger comprised of a single-pass tubular coil configured in a highly oscillating or serpentine manner and oriented along multiple axes so as to maximize its exposure to the heat generated by the oil-fired burner assemblies. The design of the heat exchanger includes a horizontal tunnel configured within a bottom portion. The oil-fired burner assemblies are configured and oriented in relation to the tunnel so that their flames are initially generated in a horizontal fashion into the tunnel within the heat exchanger.

The present invention further includes a novel forced-air combustion and cooling system. The forced-air system is comprised of a primary air system and a secondary air system. The primary air system provides pressurized air directly to the oil-fired burner assemblies to maximize atomization and combustion of the fuel oil. The secondary air system provides pressurized air to strategic positions within the firebox to assist in controlling the cooling of the firebox and to maximize the combustion of the fuel/air mixture. The primary and secondary air systems are powered by hydraulic pumps integral to the overall system. The present invention also Includes systems for regulating and adjusting the fuel/air mixture within the firebox to maximize the combustion efficiency.

The improved system of the present invention also includes several subsystems for maximizing the safety and efficiency of the heat exchanger system. The system includes a novel hood mechanism attached to the exhaust stack of the firebox. In addition, the system includes a novel intake air muffler/silencer system, which significantly reduces the noise generated by the intake of such large quantities of ambient air.

The system also includes novel methods for heating large volumes of treatment fluids, such as water, in a continuously flowing fashion so that heating operations can be performed "on-the-fly", i.e., without the use of preheated stockpiles of treatment fluid. For example, water at ambient conditions can be drawn into the device of the present invention and heated so that sufficient volumes of continuously flowing heated treatment fluid may be supplied directly to the well head for conducting hydraulic fracturing operations on the well. The system also includes novel methods for controlling the heating of the treatment fluid as it passes through the system. The system further includes novel methods for controlling the temperature change and volume flow of treatment fluid as it passes through the system.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
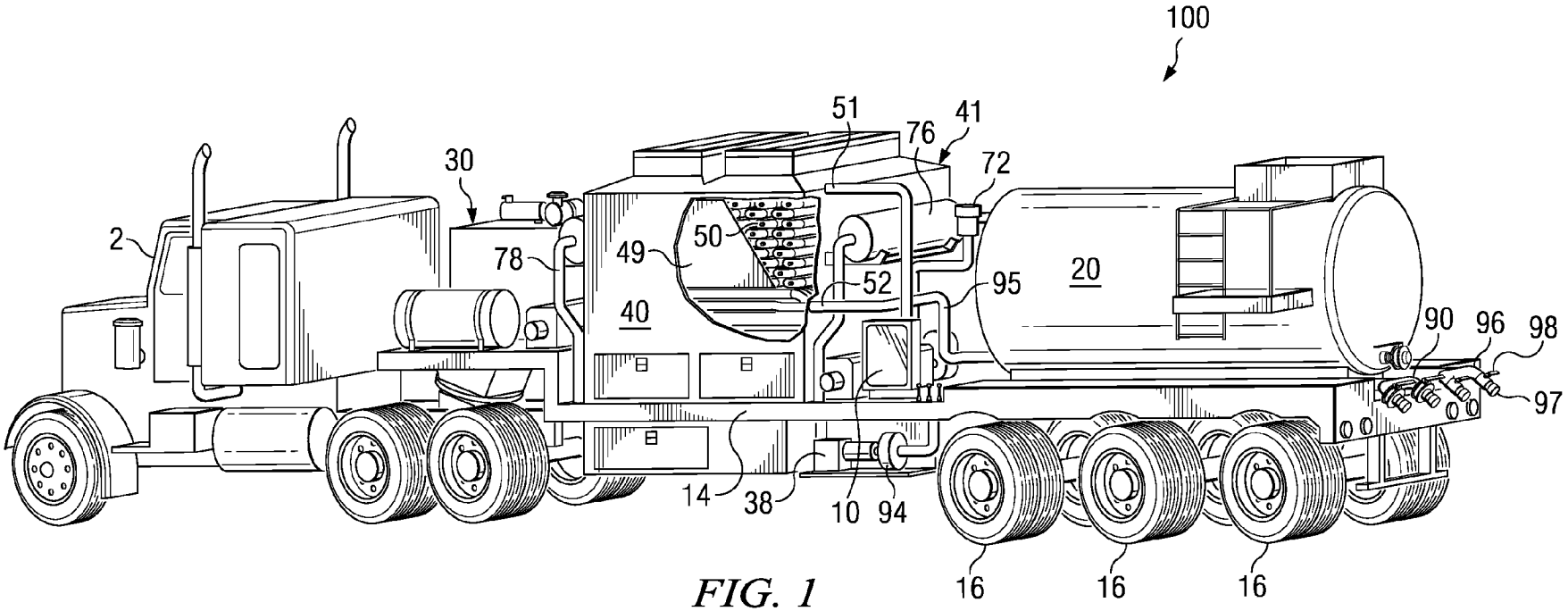
FIG. 1 is a perspective view of an embodiment of the Oil-Fired Heat Exchanger of the present invention.

Where used in the various Figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION OF THE INVENTION

With reference to the Figures, and in particular to FIG. 1 powered and 2A-C, an embodiment of the improved oil-fired heat exchanger system 100 of the present invention is shown. The embodiment 100 shown in the Figures is configured to be an oil-fired frac water heater system. As depicted, the embodiment of the frac water heater system 100 is configured on a drop deck trailer 14 and suitable for transport to remote oil field sites. The system 100 includes a fuel storage and supply system, a firebox 40 containing a single heat exchanger 50, primary 70 and secondary 80 air supply systems connected to the firebox 40, and an auxiliary power plant 30 for driving an accessory gearbox 32. The accessory gearbox 32, in turn, drives multiple hydraulic pumps, which power a main fluid pump 94 and the air supply systems. The main fluid pump 94 is used to draw fluid, such as water, from a fluid source and supply it to the intake 51 of the heat exchanger 50. The hydraulic pressure generated by the main fluid pump 94 effectively pumps the fluid through the heat exchanger 50 where it is heated. As the treatment fluid proceeds through a single pass of the heat exchanger 50 it increases in temperature until it reaches an outlet 52 of the heat exchanger 50 where it is directed via tubular conduits or hose to the well head for injection into the formation. The system 100 also includes a control quadrant 10 and control levers 12 for operating and monitoring the system 100.

As shown in the embodiment depicted in the Figures, the entire frac water heater system 100 is configured on a single drop deck trailer 14 having multiple wheels 16 and connected to a separate towing vehicle 2. It is understood that alternate embodiments of the system of the present invention may be skid mounted or configured integral to a single vehicle. In addition, the subject invention may also be configured so that one or more of the various components of the system (e.g., fuel tank 20, firebox 40, auxiliary power plant 30) are configured on separate trailers, vehicles or skids for transport to the remote work site.

With reference again to the Figures, and in particular to FIGS. 2A-2C and 3, the components of the embodiment of the improved oil-fired heat exchanger system 100 of the present invention will be described in greater detail. As depicted in the Figures, the embodiment the present invention 100 is disposed on a single trailer rig 14 and includes a firebox 40 containing a single heat exchanger 50, primary 70 and secondary 80 air supply systems connected to the firebox 40, a fuel system for storing and supplying fuel to multiple burner assemblies 60 configured in the firebox 40, and an auxiliary power plant 30, which powers multiple hydraulic systems and assorted auxiliary systems.

Auxiliary Power Plant & Hydraulic System

As depicted in the Figures, the auxiliary power plant 30 is configured near the front end of the trailer 14. The auxiliary power plant 30 provides power for driving an accessory gearbox 32 and assorted auxiliary systems (e.g., electric, pneumatic), in one embodiment, the auxiliary power plant 30 comprises a diesel engine, which includes an electric alternator and air compressor. Alternatively, the electric alternator and air compressor may be powered by the accessory gearbox 32. The electric alternator provides electrical power to the system 100 and the pneumatic compressor provides pneumatic pressure for controlling the system 100.

The auxiliary power plant 30 provides the primary motive force for driving the accessory gearbox 32. The accessory gearbox 32, in turn, drives multiple hydraulic pumps that power the hydraulic systems of the present invention. Each hydraulic pump is used to power an independent hydraulic circuit. For example, in the depicted embodiment, the accessory gearbox 32 powers three hydraulic circuit systems. The first hydraulic circuit includes a first hydraulic pump 33 that supplies pressurized hydraulic fluid via supply/return line 33*a* to a first hydraulic motor 36, which powers the first air blower system. The second hydraulic circuit includes a second hydraulic pump 34 that supplies pressurized hydraulic fluid via supply/return line 34*a* to the second hydraulic motor 37, which powers the second air blower system. The third hydraulic circuit includes a third hydraulic pump 35 that supplies pressurized hydraulic fluid via supply/return line 35*a* to a third hydraulic motor 38, which powers the main fluid pump 94. The three hydraulic systems are supplied by a hydraulic reservoir 31 positioned near the accessory gearbox 32. In a preferred embodiment, the three hydraulic pumps 33, 34, 35 each comprise a mechanically-driven, variable-displacement, hydraulic pump; while the three hydraulic motors 36, 37, 38 each comprise fixed displacement hydraulic motors. The hydraulic pumps 33, 34, 35 are rated at 5000 psi, but typically operated at approximately 2500-3000 psi.

Treatment Fluid Supply System

The main fluid pump 94 is used to draw a treatment fluid, such as water, from a fluid source and supply it to the inlet 51 of the heat exchanger 50. The main fluid pump 94 is typically integral to the system 100 and has sufficient power to both draw the treatment fluid from a source and to pump the treatment fluid through the heat exchanger 50 and on to the well head for subsequent injection into the formation. In one embodiment, the main fluid pump 94 comprises a hydraulically-powered centrifugal fluid pump that is capable of supplying treatment fluid to the heat exchanger 50 at a pressure of about 150 psi. The volume of treatment fluid pumped through the heat exchanger 50 will vary with the pump speed. In a preferred embodiment, the main fluid pump 94 is capable of pumping a maximum of 252 gpm of treatment fluid through the heat exchanger 50.

As shown in the Figures, the fluid supply system may include an intake 90 manifold for connecting one or more supply hose (not shown) to the system's respective intake. The intake manifold 90 may include one or more spigots 91 for receiving supply hose in fluid communication with the fluid source. Each inlet spigot 91 may further include a valve mechanism 92, which selectively controls the fluid flow through its respective inlet spigot 91. Tubular intake conduits 93*a*, 93*b* fluidly connect the inlet of the main fluid pump 94 with the intake manifold 90. Conduit 93*c* fluidly connects the outlet of the main fluid pump 94 with the inlet 51 of the heat exchanger 50. The hydraulic pressure generated by the main fluid pump 94 effectively pumps the fluid through the heat exchanger 50 where it is heated. As the treatment fluid proceeds through a single pass of the heat exchanger 50 it increases in temperature until it reaches an outlet 52 of the heat exchanger 50 where it is directed via tubular outlet conduit 95 and supply hose (not shown) to the well head for injection into the formation. As shown in the Figures, the fluid supply system may further include an outlet manifold 96 having one or more spigots 97 for connecting with supply hose. Each outlet spigot 97 may further include a valve mechanism 98, which selectively controls the fluid flow through its respective outlet spigot 97.

Fuel Supply & Control System

Figure 7:
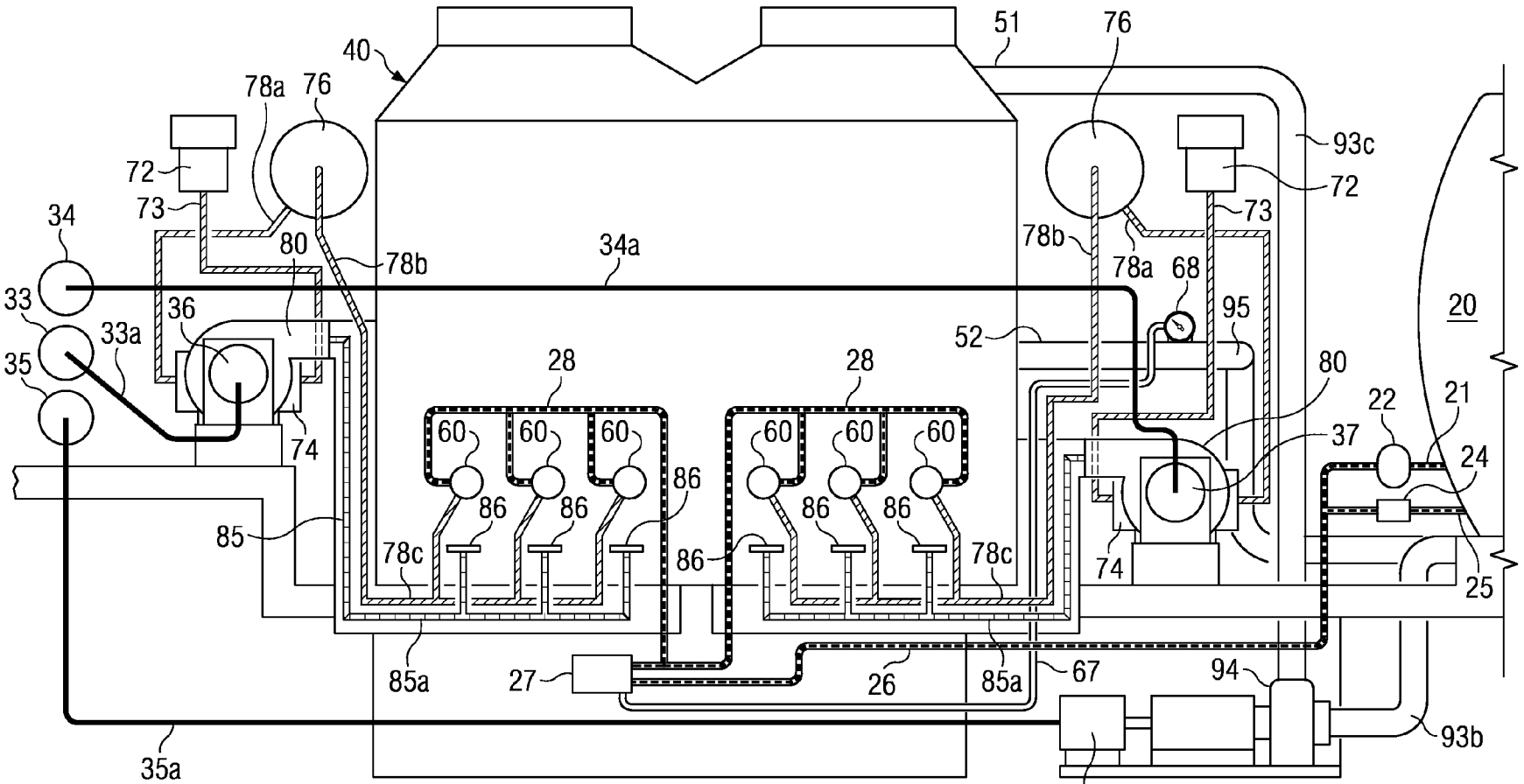
FIG. 7 is a schematic depiction of the hydraulic, fuel, and air supply systems of the embodiment of the Oil-Fired Heat Exchanger of the present invention shown in FIG. 1.
Figure 8:
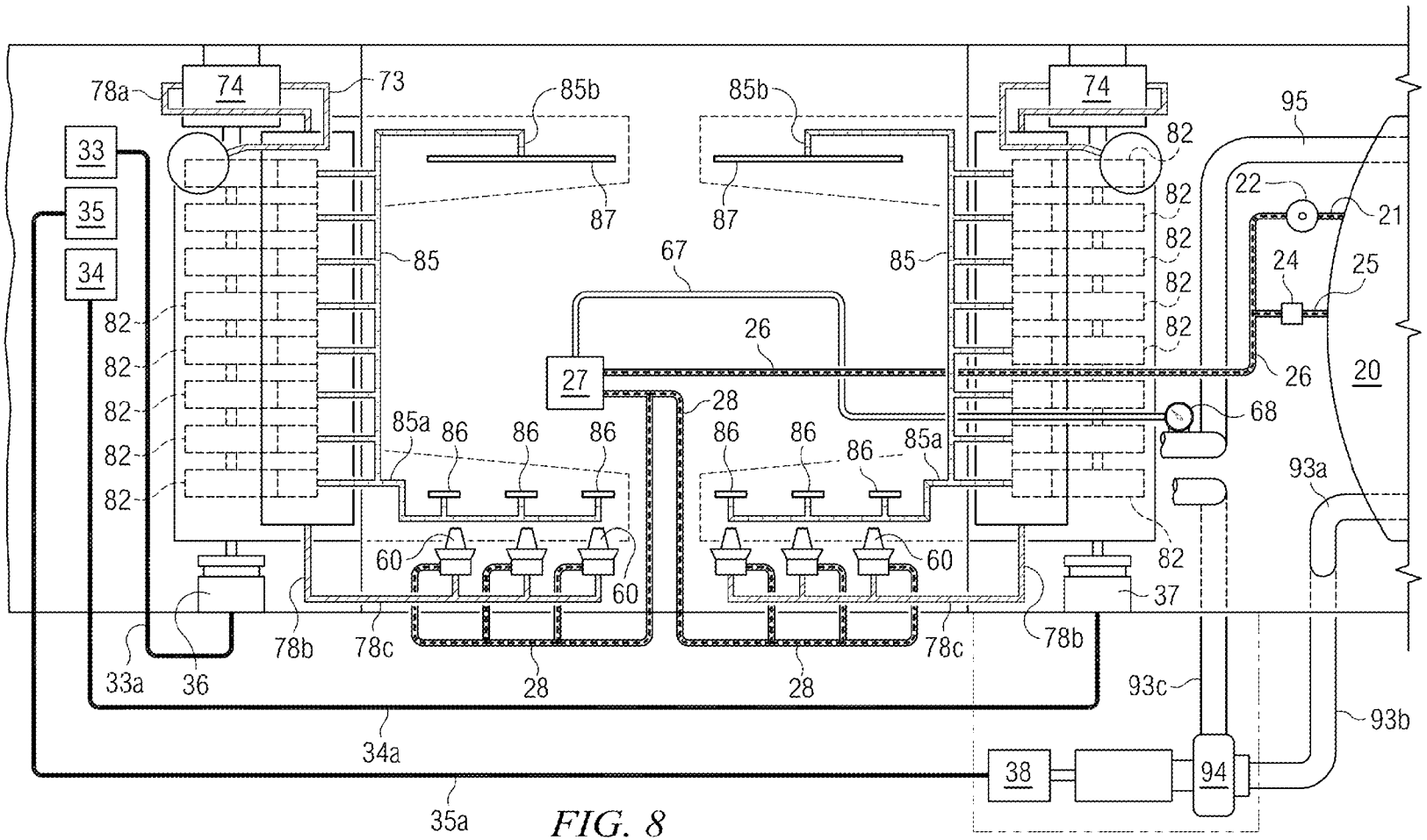
FIG. 8 is an overhead view of the schematic depiction of the hydraulic, fuel, and air supply systems of the embodiment of the Oil-Fired Heat Exchanger of the present invention shown in FIG. 7.

As shown in the Figures and schematically depicted in FIGS. 7 and 8, the fuel system includes a fuel tank 20, which is configured near the rear or back end of the trailer 14. The fuel tank 20 is typically unpressurized and used to store the liquid fuel used by the multiple burner assemblies 60 configured in the firebox 40. In the depicted embodiment 100, the fuel tank 20 is unpressurized and can hold up to 60 bbl of diesel fuel. The fuel system also includes an unpressurized fuel line 21, which supplies fuel from the fuel tank 20 to the intake of a fuel pump 22. The fuel pump 22 boosts the fuel pressure and directs it to the multiple burner assemblies 60 by means of a pressurized fuel line 26. In one embodiment, the fuel pump 22 boosts the fuel pressure to approximately 50-100 psi, preferably 60 psi.

The fuel system also includes a pressure relief valve 24 in fluid communication with the pressurized fuel line 26. The pressure relief valve 24 permits fuel to vent back into the fuel tank by means of fuel line 25 when the fuel pressure in the pressurized fuel line 26 exceeds a certain pressure.

The fuel system further includes a fuel pressure control motor valve 27, which regulates the flow of fuel from the pressurized fuel line 26. The pressurized fuel line 26 fluidly connects the outlet of the fuel pump 22 with the inlet of a fuel pressure control motor valve 27. The fuel pressure control motor valve 27 controls the amount of fuel supplied to the multiple burner assemblies 60 via pressurized metered fuel lines 28. As depicted in the drawings, the metered fuel lines 28 may be configured so as to supply pressurized fuel to sets of burner assemblies, which are comprised of more than one burner assembly 60. The fuel pressure control motor valve 27 may be electrically, pneumatically or hydraulically actuated. In a preferred embodiment, the fuel pressure control motor valve 27 comprises a pneumatically-actuated flow control valve.

The temperature of the treatment fluid exiting the heat exchanger outlet 52 is a function of three variables: the volumetric flow rate of the treatment fluid through the heat exchanger 50; the flow rate of the pressurized secondary air; and the heat generated by the multiple burner assemblies 60 configured in the heat exchanger 50. The flow rate of the secondary air is typically held constant during all operations while the volumetric flow rate of the treatment fluid is typically constant for a given operation. Thus, the temperature of the treatment fluid exiting the heat exchanger outlet 52 is controlled by regulating the volume of fuel supplied to the multiple burner assemblies 60.

An adjustable temperature controller mechanism 68 is used to send a control signal, which causes the fuel pressure control motor valve 27 to open or close, thereby increasing or decreasing the volume of fuel supplied to the multiple burner assemblies 60 via pressurized metered fuel lines 28. The control signal may comprise an electrical, wireless, pneumatic, or hydraulic signal. For example, in one embodiment, the adjustable temperature controller mechanism 68 comprises a simple manual rotary or slider rheostat device, which controls an electric signal that controls the actuation of the fuel pressure control motor valve 27. In another embodiment, the adjustable temperature controller mechanism 68 comprises a simple manual rotary valve, which controls a pneumatic pressure signal that controls the actuation of the fuel pressure control motor valve 27.

The temperature controller mechanism 68 may further includes a thermostat mechanism, which continually monitors the temperature of the treatment fluid exiting the heat exchanger outlet 52 and automatically adjusts the control signal to the fuel pressure control motor valve 27 to open or close as necessary to maintain a set point temperature.

Thus, the fuel pressure supplied to the multiple burner assemblies 60 is initially generated by the fuel pump 22 and regulated by the fuel pressure control motor valve 27. For example, in the previously noted embodiment, the fuel pump 22 boosts the fuel pressure to approximately 50-100 psi, preferably 60 psi. The fuel pressure is limited to a maximum pressure of 100 psi by the pressure relief valve 24, which permits fuel to vent back into the fuel tank by means of fuel line 25 when the fuel pressure in the pressurized fuel line 26 exceeds 100 psi. The fuel pressure control motor valve 27 regulates the maximum fuel pressure supplied to the multiple burner assemblies 60 via pressurized metered fuel lines 28 to approximately 60 psi.

Firebox

As depicted in the Figures, the firebox 40 is configured near the center of the trailer 14. The firebox 40 is a closed-bottomed box having one or more exhaust stacks 42 configured near the top. In a preferred embodiment, the outer shell of the firebox 40 is constructed substantially of 3/16" carbon steel. The firebox 40 houses a single heat exchanger 50 and a plurality of burner assemblies 60 for heating a treatment fluid during a single pass through the heat exchanger 50. The closed-bottom design of the firebox 40 ensures the plurality of burner assemblies 60 are less susceptible to changes in ambient conditions, such as wind direction or gustiness. The interior walls and bottom of the firebox 40 are lined with an insulating refractory material. The refractive lining 48 is configured between the interior walls and bottom of the firebox 40 and the heat-exchanger 50. In one embodiment, the refractive lining 48 comprises one or more layers of fiber-type insulation coated with a cementious refractive compound.

Exhaust Stacks

Figure 2A:
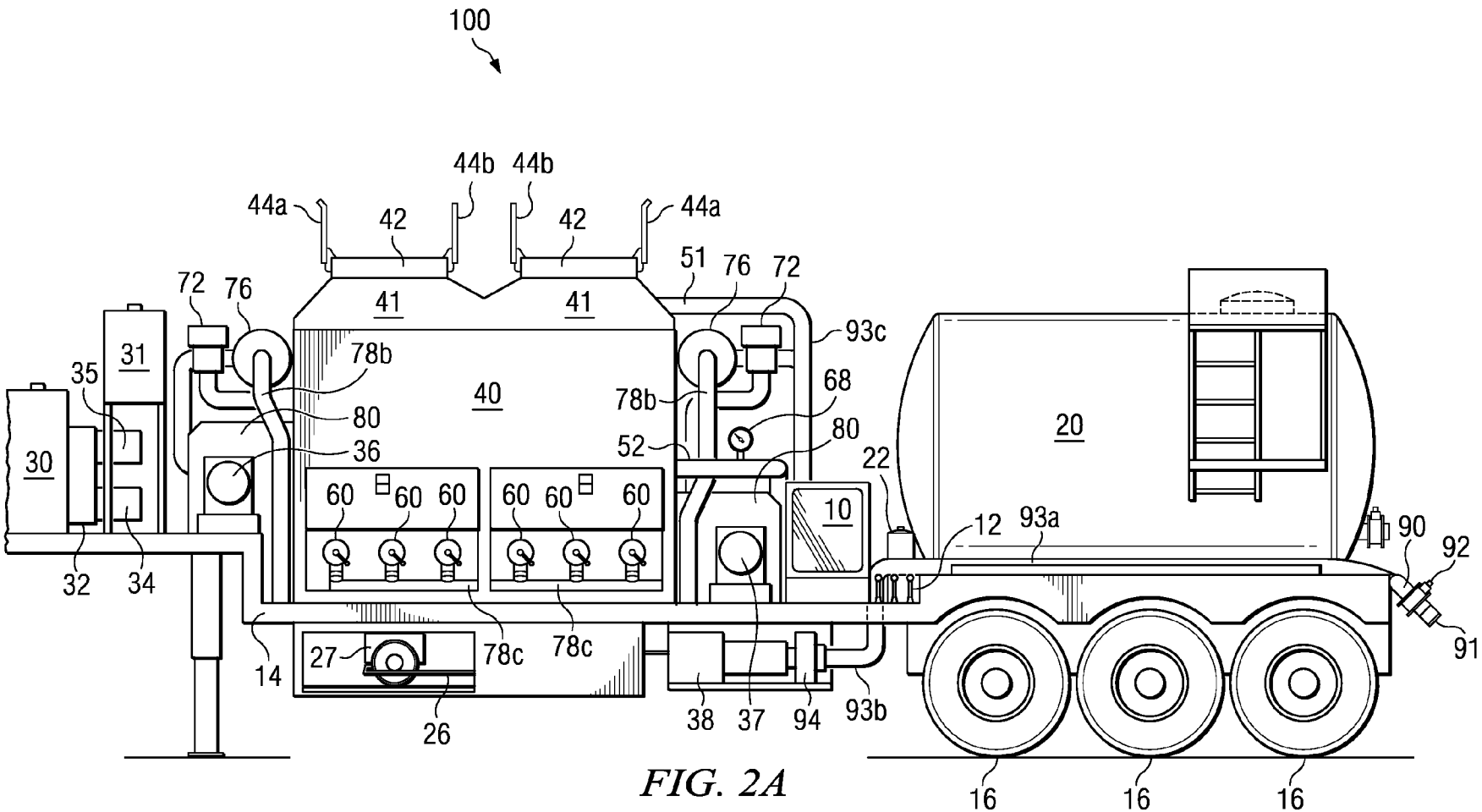
FIG. 2A is a left side elevation view of the embodiment of the Oil-Fired Heat Exchanger of the present invention shown in FIG. 1.

As previously noted, one or more exhaust stacks 42 are configured near the top the firebox 40 providing an exhaust for flue gases to exit the firebox 40. In the depicted embodiment, the firebox 40 further includes a tapered hood assembly 41, which incorporates the one or more exhaust stacks 42. The tapered hood assembly 41 is removable so as to allow access to the heat exchanger 50 for servicing. Each exhaust stack 42 also includes a hood door assembly 44, which is opened when the system 100 is operating. As depicted in FIG. 2A, each hood door assembly 44 includes two doors 44*a*, 44*b* which are pivotally mounted to opposing sides of a respective exhaust stack 42.

Hood Door Opening Mechanism

Figure 2B:
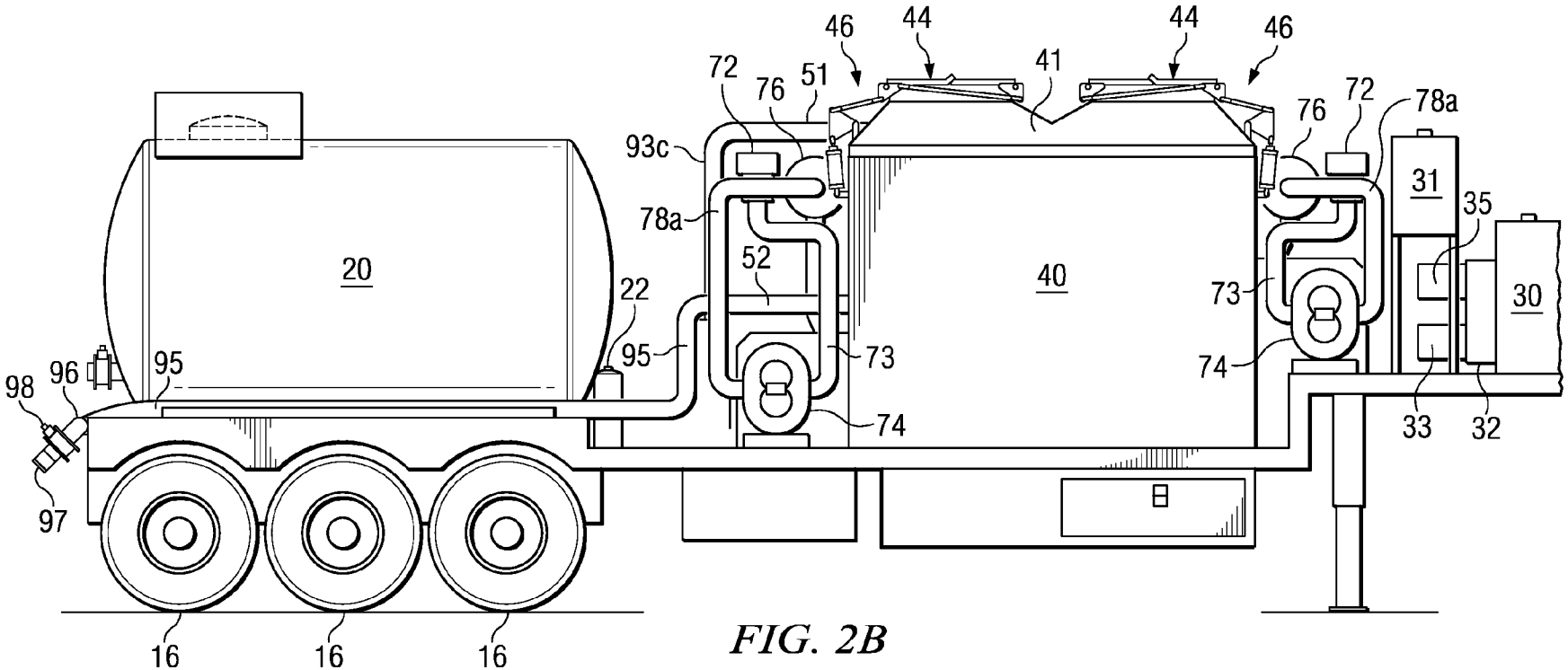
FIG. 2B is a right side elevation view of the embodiment of the Oil-Fired Heat Exchanger of the present invention shown in FIG. 1.
Figure 2C:
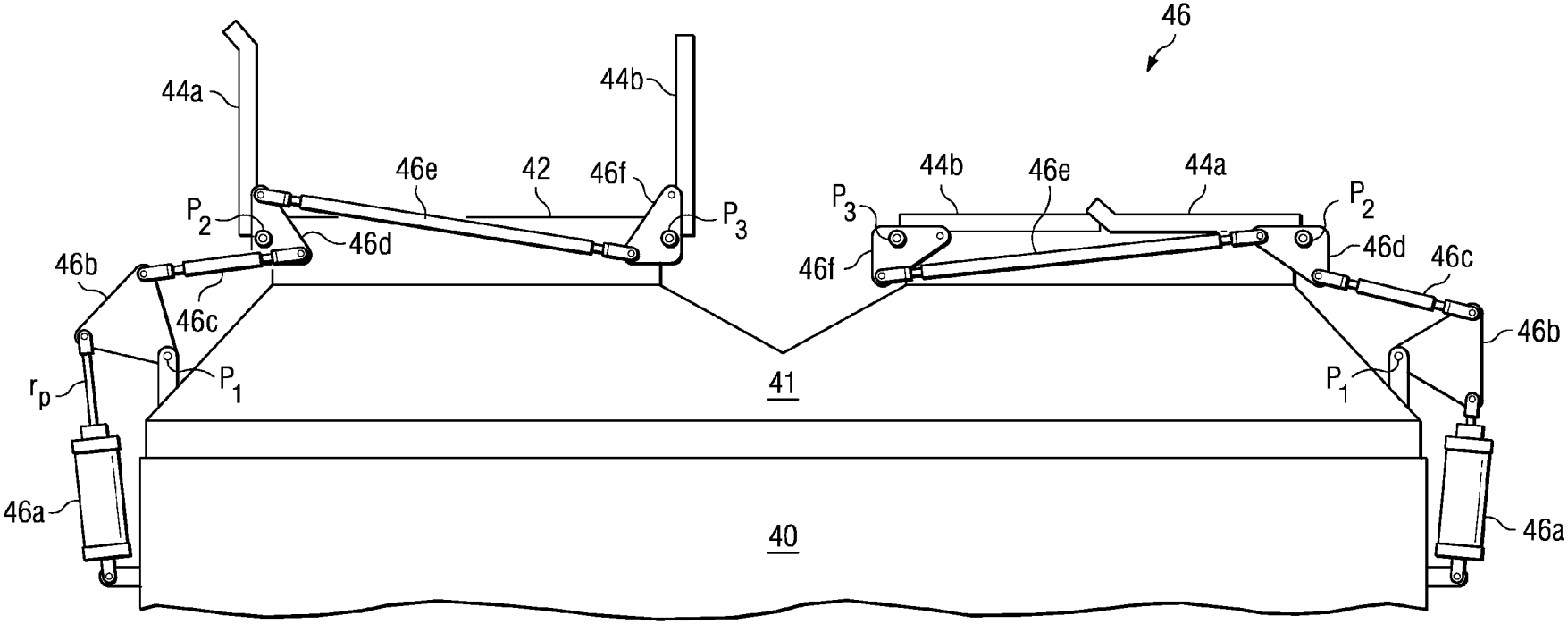
FIG. 2C is a close-up view of the mechanism for opening and closing the opposing hood doors of the embodiment of the Oil-Fired Heat Exchanger of the present invention shown in FIG. 2B.
Figure 3:
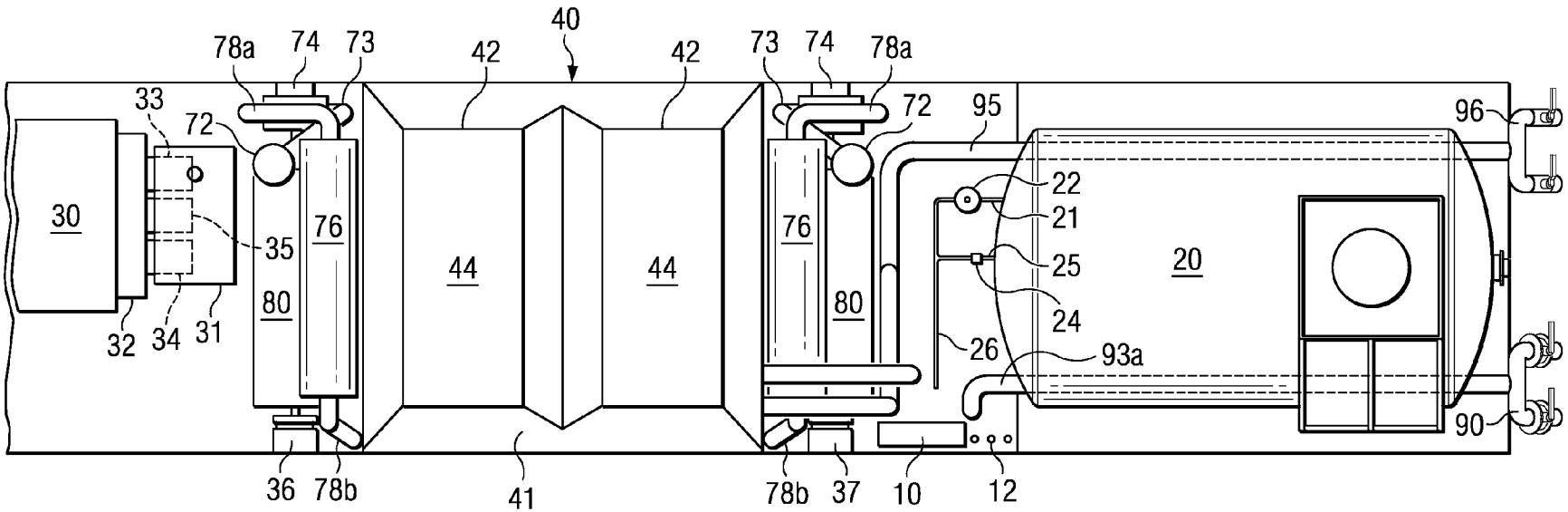
FIG. 3 is a overhead plan view of the embodiment of the Oil-Fired Heat Exchanger of the present invention shown in FIG. 1.

With reference to FIG. 2B, each hood door assembly 44 may further include a novel mechanism 46 for opening and closing the opposing hood doors. As shown in greater detail in FIG. 2C, the mechanism 46 comprises a series of bell crank mechanisms, which cause the hood doors to open or close when actuated. The embodiment in FIG. 2C depicts the hood door assembly 44 on the left side in an opened position and the hood door assembly 44 on the right side in a closed position. Each mechanism 46 comprises a piston 46*a* having one end attached to the firebox 40 and a second end attached to a first bell crank 46*b*. The first bell crank is pivotally attached to the side of the firebox 40. When actuated, the piston 46*a* causes the first bell crank 46*b* to rotate about its pivot, point $p_1$. The first bell crank 46*b* also includes a pivotally attached push rod linkage 46*c* that connects the first bell crank 46*b* to a second bell crank 46*d*, which is fixably attached to the side edge of one of the hood doors 44*a*. The second bell crank 46*d* is configured so that its pivot point $p_2$ is co-aligned with that of its respective hood door. The second bell crank 46*d* also includes a pivotally attached push rod linkage 46*e* that connects the second bell crank 46*d* to a third bell crank 46*f*, which is also fixably attached to the side edge of the other of the hood doors 44*b*. The third bell crank 46*f* is also configured so that its pivot point $p_3$ is co-aligned with that of its respective hood door. Actuating the piston 46*a* causes the extension or retraction of a piston rod $r_p$, which causes each of the three bell cranks to rotate simultaneously about their respective pivot points. This, in turn, causes the hood doors 44*a*, 44*b* to pivot open or closed as desired. In a preferred embodiment, the piston 46*a* is a pneumatically actuated piston.

Burner Assemblies

The firebox 40 also includes a plurality of burner assemblies 60, which are configured in the lower side of the firebox 40. As will be subsequently described in greater detail, each of the burner assemblies 60 are connected to the fuel system and a pressurized air supply. For example, as schematically depicted in FIGS. 7 and 8, liquid fuel is supplied to each burner assembly 60 via the metered pressurized fuel line 28. Similarly, pressurized air for combustion is supplied to each burner assembly 60 via a primary air conduit 78*c*. The pressurized air and fuel are combined in the burner assembly 60 and directed through an atomizer nozzle 64, which projects an atomized fuel spay into the firebox 40 where it is combusted. Each burner assembly 60 is configured in the lower side of firebox 40 so as to initially generate a substantially horizontal combustion flow within the firebox 40. Each burner assembly 60 includes self-contained controls for adjusting the fuel-air mixture and an ignition mechanism for initially igniting the fuel-air mixture. In a preferred embodiment, the burner assembly 60 comprises a 780-Series self-proportioning, oil-fired burner manufactured by the Hauck Manufacturing Company of Lebanon, Pa.

Heat Exchanger

The heat exchanger 50 contained within firebox 40 is comprised of a tubular coil which is configured in a highly oscillating or serpentine manner and oriented along multiple axes so as to maximize its exposure to the heat generated by the oil-fired burner assemblies 60. The heat exchanger coil 50 includes a single inlet 51 configured at or near the top of the heat exchanger coil 50 and a single outlet 52 configured at or near the bottom of the heat exchanger coil 50. Such a configuration greatly improves the efficiency of the system 100 by minimizing the back pressure exerted on the main fluid pump 94 by the treatment fluid and providing a gravity assist to the flow of treatment fluid through the heat exchanger 50. As the treatment fluid proceeds through a single pass through of the heat exchanger coil 50 it increases in temperature until it reaches the outlet 52 where it is directed, via an outlet conduit 95 and supply hose (not shown), to the well head for injection into the formation.

Figure 4A:
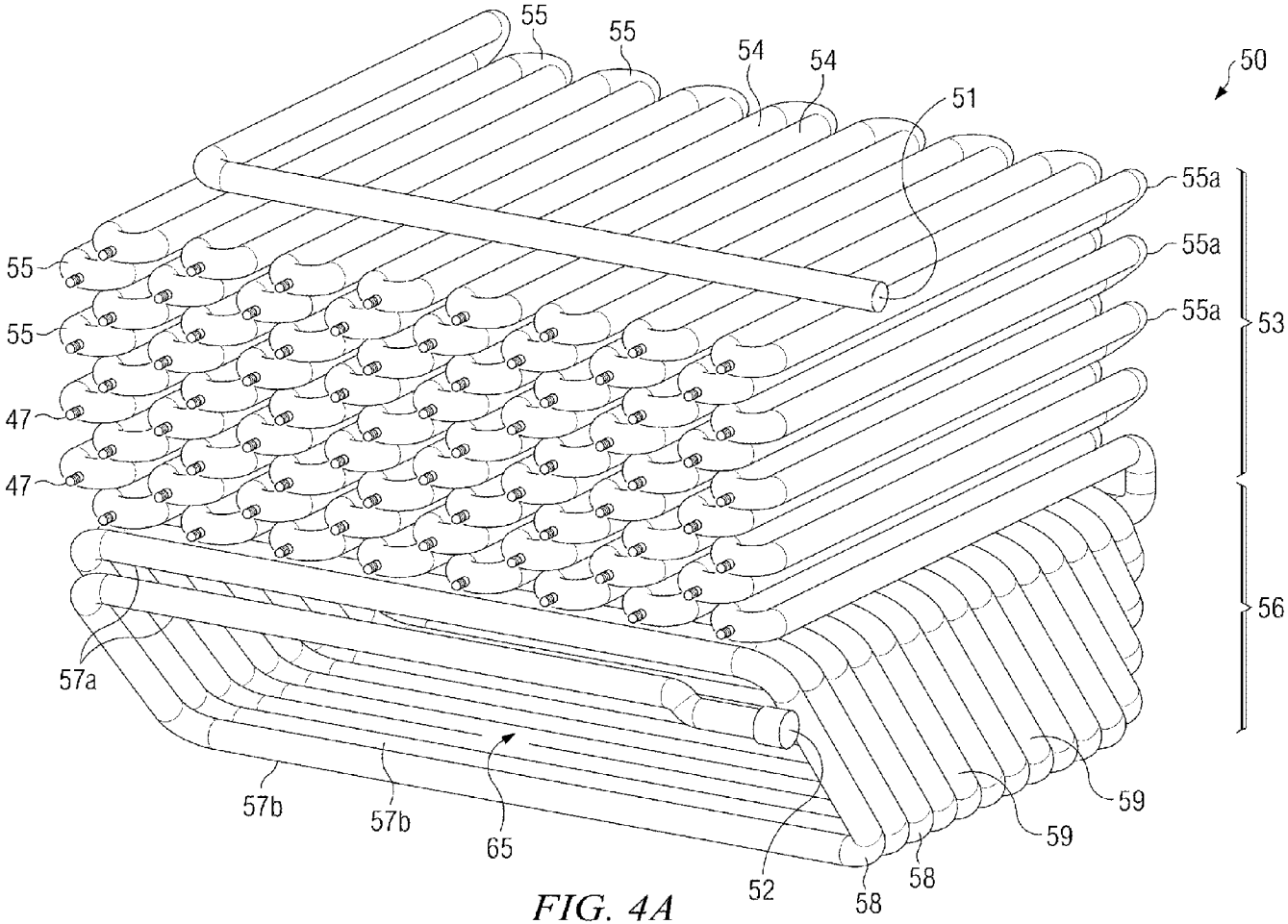
FIG. 4A is a front perspective view of an embodiment of the heat exchanger of the Oil-Fired Heat Exchanger of the present invention.
Figure 4B:
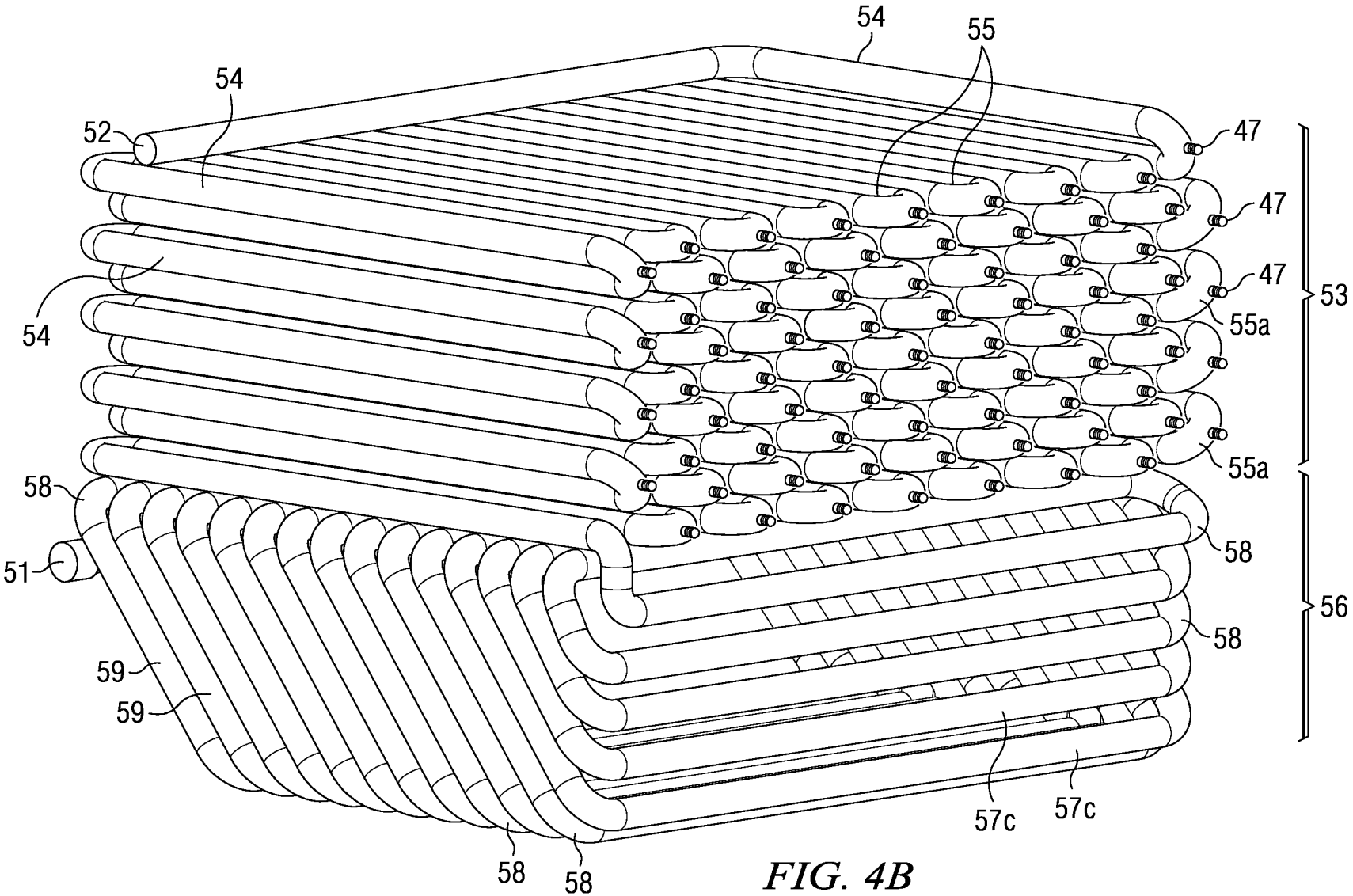
FIG. 4B is a back perspective view of the embodiment of the heat exchanger shown in FIG. 4A.

With reference now to FIGS. 4A-4B, an embodiment of the heat exchanger 50 of the present invention is depicted. The heat exchanger 50 is comprised of a tubular coil which is configured in a highly oscillating and serpentine manner and oriented along two axes so as to maximize its exposure to the heat generated by the oil-fired burner assemblies 60. For example, the depicted embodiment of heat exchanger 50 includes an upper portion 53 configured in stacked horizontal rows of tubing faked down in a series of reversing loops oriented about a vertical axis; and a lower portion 56 configured in a helical coil oriented about a horizontal axis. The upper portion 53 is fluidly connected to the lower portion 56 forming the single heat exchanger 50. In one embodiment, the upper 53 and lower 56 portions of the tubular coil of the heat exchanger 50 comprise approximately 1,300 ft. of 3" seamless steel pipe with weld fittings.

Each row of the upper portion 53 of the heat exchanger 50 is constructed of a plurality of tubes 54 aligned in parallel with each other. The outlet of each tube 54 is connected in series with the inlet of an adjacent tube 54 by means of an approximate 180° curved tube or return bend 55. Similarly, each planar row is connected in series to the adjacent rows above and below by connecting the outlet of the outermost tube in one row with the inlet of the outermost tube in another row by means of a return bend 55*a*. In a preferred embodiment, each planar row is laterally offset from the planar row above and below it so that the tubes 54 in one row are centered on the space between two adjacent tubes 54 in the rows above and below it.

Each return bend 55 may further include an alignment bolt 47 extending from the approximate exterior inflection point of the return bend 56. The multiple alignment bolts 47 correspond to holes formed in an alignment plate 49, which is fixably attached to the upper portion 53 of the heat exchanger 50 by means of mechanical fasteners 45, such as threaded nut fasteners. The alignment plate 49 maintains the alignment of the stacked planar rows of the upper portion 53 of the heat exchanger 50 so that the adjacent rows do not touch and space is maintained between all adjacent tubes 54, thereby enabling the flow of heated air through the upper portion 53 of the heat exchanger 50 during operation.

The upper portion 53 is fluidly connected in series to the lower portion 56 of the heat exchanger 50. As shown in FIGS. 4A-4B, the lower portion 56 transitions to an angled rectangular helical coil configuration, which is oriented about a horizontal plane and defines a five-sided cavity/chamber or tunnel 65. As will be described infra, the tunnel 65 serves as an effective combustion chamber for the multiple oil-fired burner assemblies 60. The lower portion 53 of the heat exchanger 50 comprises a tubular coil constructed a plurality of adjacently aligned upper 57*a* and lower 57*b* lateral tubes, which are vertically spaced and connected in series by means of quarter-bend (i.e., approximately 90° bend) tubes 58 and riser tubes 59. The outlet of each lateral tube 57 is fluidly connected in series with the inlet of the next vertically spaced lateral tube 57 by means of a quarter-bend tube 58 followed by a riser tube 59 followed by another quarter-bend tube 58. As shown in FIG. 4A, the outlet of the last lateral tube 57 in the tubular coil forming the lower portion 53 is fluidly connected to the outlet 52 of the heat exchanger 50.

Figure 4C:
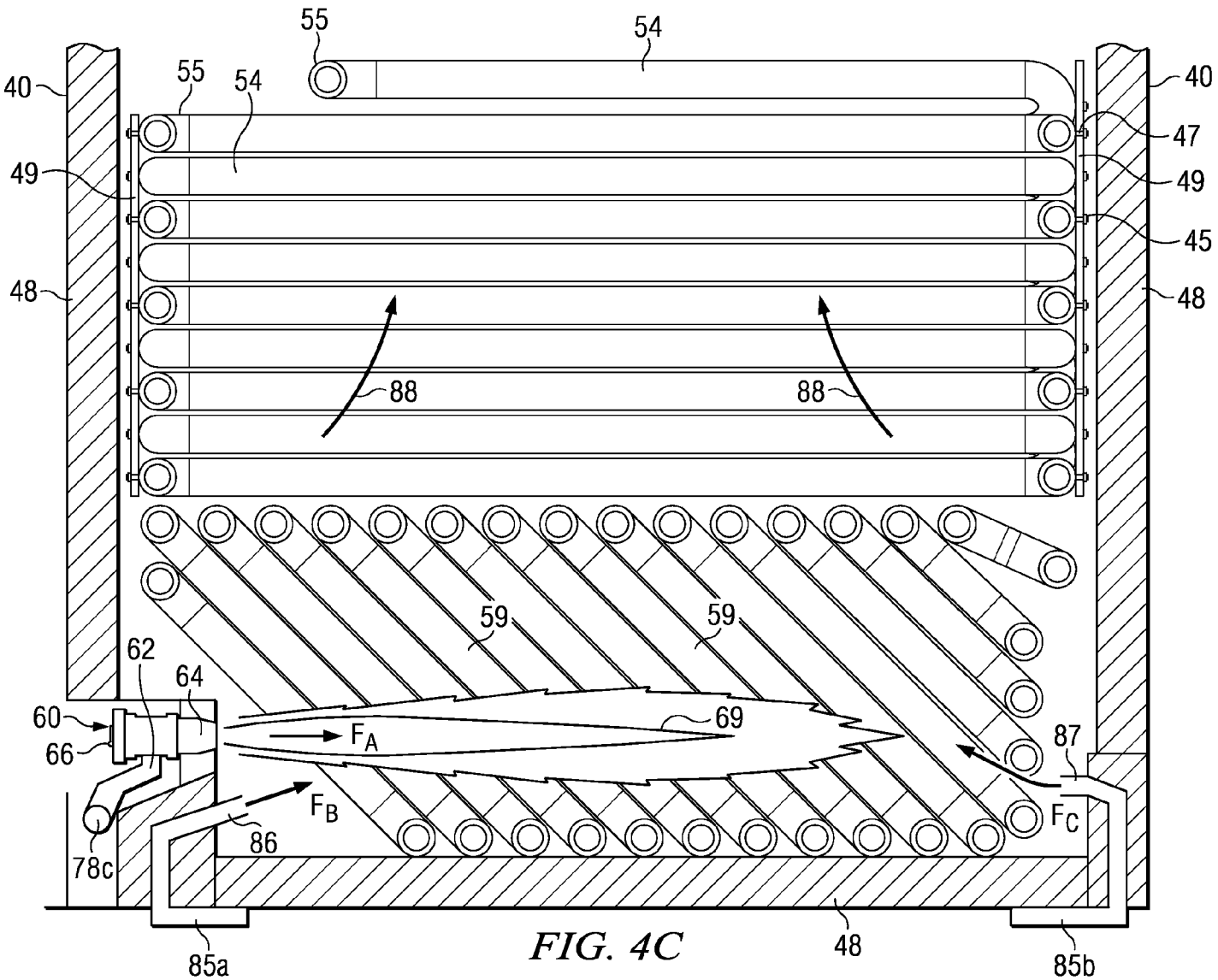
FIG. 4C is a cross-sectional view of the embodiment of the heat exchanger shown in FIGS. 4A and 4B installed in the embodiment of the Oil-Fired Heat Exchanger of the present invention shown in FIG. 1.

With reference now to FIG. 4C, a cross-sectional view of the heat exchanger 50 shown in FIGS, 4A-4B installed in the firebox 40 of the present invention is shown. The firebox 40 includes a refractive lining 48 configured between the interior walls and bottom of the firebox 40 and the tubular coil of the heat exchanger 50. As previously described, the heat exchanger 50 is comprised of a tubular coil which is configured in a highly oscillating and serpentine manner and oriented along two axes so as to maximize its exposure to the heat generated by the oil-fired burner assemblies 60. The upper portion 53 configured in tightly stacked horizontal rows of tubing faked down in a series of reversing loops oriented about a vertical axis; and a lower portion 56 configured in a helical coil oriented about a horizontal axis. The upper portion 53 is fluidly connected to the lower portion 56 forming the single heat exchanger 50. The attached alignment plate 49 maintains the alignment of the stacked planar rows of the upper portion 53 of the heat exchanger 50 so that the adjacent rows do not touch and space is maintained between all adjacent tubes 54, thereby enabling the flow of heated exhaust or flue gases 88 through the upper portion 53 of the heat exchanger 50 during operation. The lower portion 56 of the heat exchanger 50 transitions to an angled rectangular helical coil configuration, which is oriented about a horizontal plane and defines a five-sided cavity/chamber or tunnel.

The tunnel 65 serves as an effective combustion chamber for the multiple oil-fired burner assemblies 60 configured in the lower side of the firebox 40. Each burner assembly 60 is connected to the fuel system and a pressurized air supply. For example, as schematically depicted in FIGS. 7 and 8, liquid fuel is supplied from the fuel tank 20 to each burner assembly 60 via fuel pump 22, pressurized fuel line 26, fuel pressure control motor valve 27 and the metered pressurized fuel line 28. Similarly, pressurized air for combustion is supplied to a primary air inlet 62 configured on each burner assembly 60 via a primary air conduit 78*c*. With reference again to FIG. 4C, the primary air and fuel are combined in the burner assembly 60 and directed through an atomizer nozzle 64, which projects an atomized fuel spay $F_A$ into the firebox 40 where it is combusted in the previously described cavity/chamber or tunnel 65 formed in the heat exchanger 50. It is further noted that each burner assembly 60 is oriented so as to initially generate a substantially horizontal combustion flow 69 within the firebox 40. Each burner assembly 60 includes self-contained controls 66 for adjusting the fuel-air mixture and an ignition mechanism for initially igniting the fuel-air mixture.

The firebox 40 depicted in FIGS. 4C, 7 and 8 further includes ductwork 85*a*, 85*b*, which supply pressurized secondary air to the interior of firebox 40. The pressurized secondary air assists in directing and regulating the flow of heated flue gases 88 through the heat exchanger 50 during operation. The ductwork 85*a*, 85*b* supplies pressurized secondary air to vents 86, 87 configured on opposing sides of the firebox 40. The vents 86, 87 are typically configured so that their respective airflows $F_B$, $F_C$ are generally directed into the cavity/chamber or tunnel 65 formed in the heat exchanger 50. The secondary airflows $F_B$, $F_C$, which are projected from their respective vents 86, 87, assist in regulating and directing the flow of heated flue gases 88 through the heat exchanger 50 during operation.

For example, a first or front vent 86 is configured under the burner assemblies 60 and projects a first flow of secondary pressurized air $F_B$ into the open front portion of the cavity/chamber or tunnel 65 formed in the heat exchanger 50. In one embodiment, the first vent 86 comprises an individual nozzle vent configured under each burner assembly 60. The first flow of secondary pressurized air $F_B$ provides a thermal air barrier that partially insulates the lateral tubes 57*b* on the bottom of the heat exchanger 50 from the substantially horizontal combustion flame 69 generated by the burner assembly 60. In addition, the first flow of secondary pressurized air $F_B$ absorbs the heat produced by the substantially horizontal combustion flow 69 generating a flow of heated flue gases 88, which exhausts up through the heat exchanger 50 during operation. In a preferred embodiment, the first vent 86 is angled at a slightly upward angle, so that the first flow of secondary pressurized air $F_B$ combines with the atomized fuel spay $F_A$ to effectively supercharge the resulting combustion flow 69 with additional air.

The second or rear vent 87 is configured on the opposing wall or side from the first, vent 86 and burner assemblies 60, and projects a second flow of secondary pressurized air $F_C$ into the rear portion of the cavity/chamber or tunnel 65 formed in the heat exchanger 50. As depicted in Figures, the rear portion of the cavity/chamber or tunnel 65 formed in the heal exchanger 50 is partially obscured by the lateral tubes 57*c* traversing the tunnel 65. Thus, the second or rear vent 87 is configured so as to project the second flow of secondary pressurized air $F_C$ through gaps existing between adjacent lateral tubes 57. The injection of the second flow of secondary pressurized air $F_C$ provides a thermal air barrier that partially insulates the lateral tubes 57*c* traversing the back of the heat exchanger 50. In addition, the second flow of secondary pressurized air $F_C$ also absorbs the heat produced by the substantially horizontal combustion flow 69 generating a flow of heated flue gases 88, which exhausts up through the heat exchanger 50 during operation. In one embodiment, the second vent 87 may also be angled at a slightly upward angle.

Air Supply System

With reference again to the Figures, and in particular to FIGS. 5 and 6 the air supply system of the present invention will be described in greater detail. The air supply system of the present invention a forced-air or pressurized system which is not susceptible to changes in ambient conditions, such as wind direction or gustiness. The air supply system of the present invention is comprised of primary and secondary air systems. The primary air system supplies large volumes of pressurized air to the multiple burner assemblies 60 configured in the side of the firebox 40. The primary air system includes a high-pressure pump which compresses ambient air and directs it to the primary air inlet 62 of each oil-fired burner assembly 60 where it is used to atomize fuel. The secondary air system supplies large volumes of pressurized air to strategic locations within the firebox 40 to control and regulate the heating of the heat exchanger 50 and firebox 40. The secondary air system includes a secondary air blower mechanism, which draws in large volumes of ambient air. The secondary air is then directed via ductwork to the previously described vents 86, 87 configured on opposing sides of the firebox 40. The secondary air assists in maximizing the combustion of the fuel/air mixture while directing and regulating the flow of heated flue gases 88 through the heat exchanger 50 during operation. By controlling and regulating the heating of the heat exchanger 50 and firebox 40 during operation, the oil-fired heat exchanger system 100 of the present invention can continuously heat large volumes of treatment fluid safely.

In the embodiment of the present invention 100 depicted in the Figures, the air supply system is comprised of matched sets of primary and secondary blower systems disposed on opposing sides (i.e., the front and rear) of the firebox 40 in a mirror-image configuration. Each set includes a primary blower system 70 and a secondary blower system 80, which are powered by a single motor mechanism. For example, the first or front of blower system set is powered by motor 36 while the second or rear blower system set is powered by motor 37. The single motor mechanism 36, 37 are preferably hydraulically powered. For example, in the depicted embodiment, the motors 36, 37 are powered by hydraulic pumps 33, 34, respectively, which are driven by the accessory pump drive gear box 32. As noted previously, in a preferred embodiment, the hydraulic pumps 33, 34 comprise mechanically-driven hydraulic pumps which are rated at 5000 psi, but typically operate at approximately 2500-3000 psi.

Figure 5:
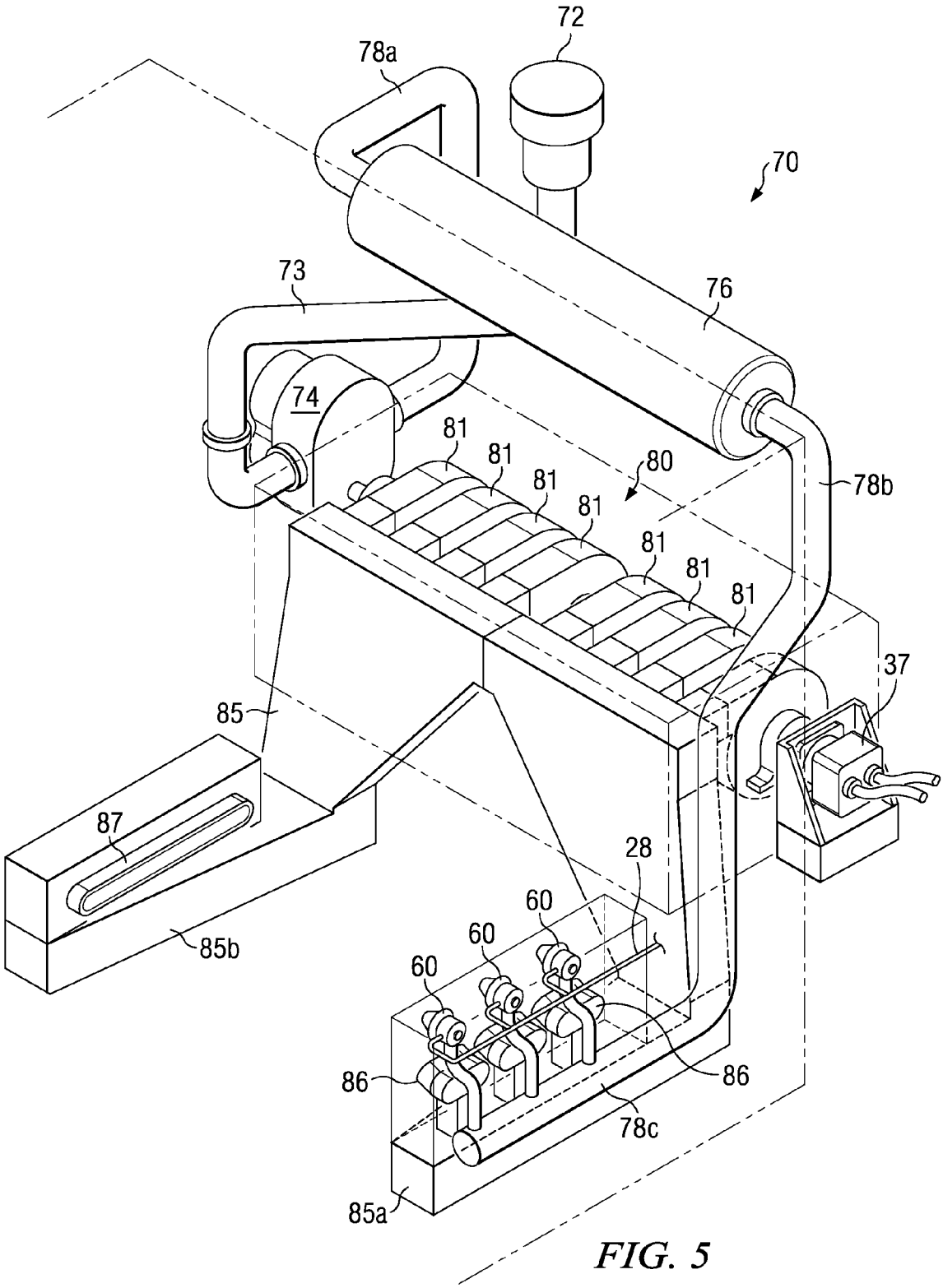
FIG. 5 is perspective view of a portion of the primary and secondary air systems of the Oil-Fired Heat Exchanger of the present invention.
Figure 6:
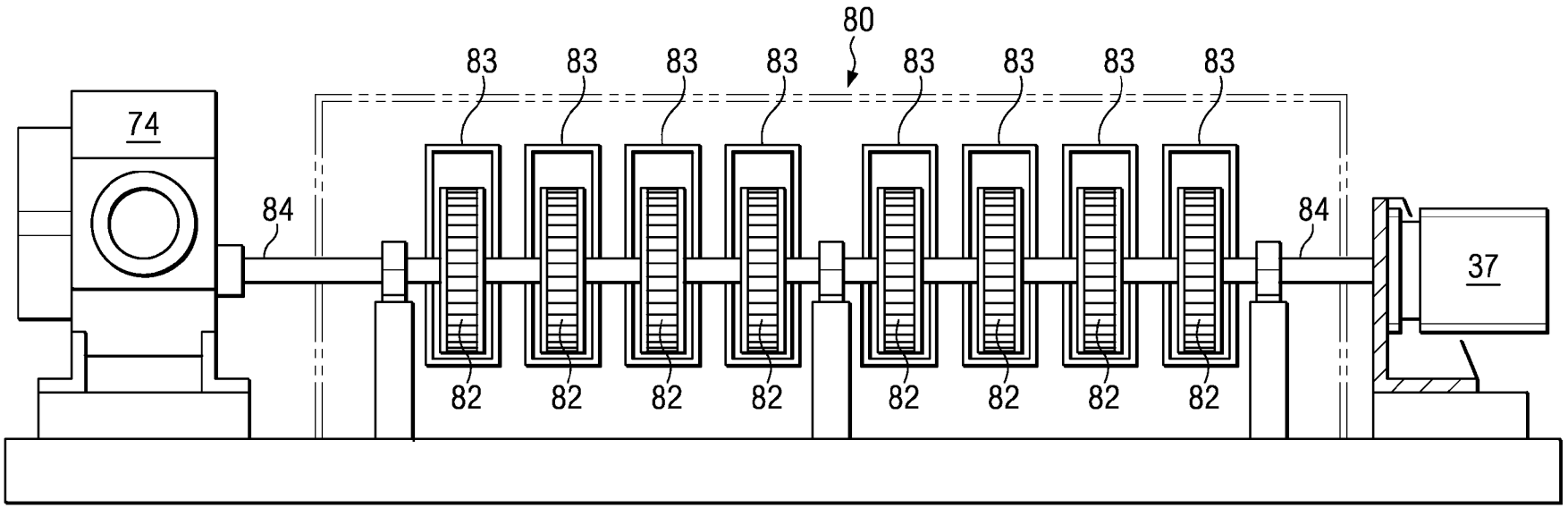
FIG. 6 is cut-away cross-sectional view of a portion of the secondary blower section of the secondary air system of the Oil-Fired Heat Exchanger of the present invention.

As shown in FIG. 5, which depicts in greater detail the second or rear blower system of the present invention 100, each primary air blower system 70 includes a high-pressure blower pump 74 having an intake which draws ambient air through an intake filter 72 and intake conduit 73. In a preferred embodiment, each high-pressure blower pump 74 is a positive displacement rotary blower. Each high-pressure blower pump 74 is powered by its respective motor mechanism 36, 37 through a rotary drives haft 84. The high-pressure blower pump 74 compresses the air and directs it via primary air conduits 78*a*, 78*b*, 78*c* to the primary air inlet 62 of each oil-fired burner assembly 60. The primary air conduits 78*a*, 78*b*, 78*c* may further include a primary air silencer 76, which muffles the noise generated by the suction of ambient air into the primary air system 70. In one embodiment, the primary air conduits 78*a*, 78*b*, 78*c* also include a pressure relief "pop-off" valve, which limits the primary air pressure to approximately 5 psi.

Each secondary air system 80 includes one or more secondary air blowers 81, which are also powered by the respective motor mechanism (e.g., 37) through a common rotary drive shaft 84. As shown in the FIG. 6, in one embodiment the one or more secondary air blowers 81 each comprise a conventional centrifugal or squirrel-cage fan mechanism 82 contained in a protective housing 83. As depicted, the one or more fan mechanisms 82 are aligned in a parallel configuration along and coupled to a common rotary driveshaft 84 so that when the driveshaft 84 rotates, each fan mechanism 82 also rotates within its housing 83. It is further noted that the co-alignment of the rotary shaft 84 with the fan mechanisms 82 of the secondary air system 80 and the high-pressure blower pump 74 of the primary air blower system 70 enables both air supply systems to be simultaneously powered by the same motor 37.

The protective housing 83 of each secondary air blower 81 includes an opening, which allows the fan mechanism 82 to draw ambient air into its housing 83 where it is directed to the ductwork of the secondary air system. The output of pressurized air from the secondary air blowers 81 is combined in a first ductwork 85, which then divides into secondary ductwork 85*a*, 85*b*, which supply pressurized secondary air to vents 86, 87 configured on opposing sides of the firebox 40. In the depicted embodiment, secondary air is pressurized to approximately 2.5-3 psi. As previously noted, the vents 86, 87 are typically configured so that their respective airflows $F_B$, $F_C$ are generally directed into the cavity/chamber or tunnel 65 formed in the heat exchanger 50. The secondary airflows $F_B$, $F_C$, which are projected from their respective vents 86, 87, assist in regulating, directing, and enhancing the convective flow of healed flue gases 88 through the heat exchanger 50 during operation.

As shown in the embodiment depicted in FIG. 5, the first or front vents 86 preferably comprise oblong circular vents positioned below the nozzles 64 of the burner assemblies 60. The depicted oblong circular vents 86 extend away from the firebox 40 wall and project one secondary air stream $F_B$ up towards the fuel/air mixture spray $F_A$ generated by the burner fuel nozzle 64. The second or rear vent 87 is configured on the opposing wall of the firebox 40. As noted previously, the configuration of the second oblong circular vents 87 provides a layer of cooling air $F_C$ between the main burner fire and the bottom of the firebox. Moreover, the angular set of the secondary vents 86, 87 causes their respective opposing secondary air flows $F_B$, $F_C$ to collide in the tunnel 65 formed in the heat exchanger 50, thereby affecting the flow of heated exhaust or flue gases 88 up and through the upper portion 53 of the heat exchanger 50 during operation.

The integrated temperature controller mechanism 68 in conjunction with forced-air supply system and refractive insulation lining 48 in the firebox 40 enable the oil-fired heat exchanger system 100 of the present invention to safely heat water continuously. Operation time is limited only by fuel supply. For example, the depicted embodiment of the present invention 100, which is configured with six (6) burner assemblies 60, typically consumes 150-165 gallons of fuel per hour. The burner fuel tank 20 on the unit holds about 2500 gallons and is therefore sized for 15-16.5 hours of continuous operation. The auxiliary powerplant 30 has its own fuel tank that holds approximately 150 gallons of fuel that allow it to operate up to 18 hours depending on operating conditions. In the field, operators may have additional fuel delivered every 12 hours or so to allow the system 100 to continue operations on large heating jobs.

Method of Operation

The system 100 of the present invention includes novel methods for heating large volumes of treatment fluid in a continuously flowing fashion so that on-site heating operations can be performed "on-the-fly", i.e., without the use of preheated stockpiles of treatment fluid. For example, the embodiment of the system 100 of the present invention depicted in the Figures, is capable of heating sufficient quantities of continuously flowing water to conduct "on-the-fly" hydraulic fracturing operations at remote well sites. The system 100 of the present invention also includes novel methods for controlling the heating of the treatment fluid as it passes through the system 100. The system 100 of the present invention further includes novel methods for controlling the temperature change and volume flow of treatment fluid as it passes through the system 100.

With reference again to the Figures and in particular FIGS. 7 and 8, the method of the present invention is depicted. A treatment fluid, such as water, is drawn from an ambient fluid source into the system 100. The treatment fluid is then pumped through a single pass of a tubular coil heat exchanger 50 contained within firebox 40 where it is heated. As the treatment fluid proceeds through the heat exchanger 50 it increases in temperature until it reaches the outlet 52 of the heat exchanger 50 where it is directed via tubular conduits or hose to the well head for injection into the formation.

The main fluid pump 94 is used to control the flow rate of the treatment fluid through the system 100. For example, a supply hose (not shown) extending to the fluid source is connected to the intake manifold 90 so as to put the system 100 in fluid communication with the fluid source. The main fluid pump 94 draws the treatment fluid via conduits 93*a*, 93*b* from the fluid source and supplies it to the inlet 51 of the heat exchanger 50. The main fluid pump 94 has sufficient power to both draw the treatment fluid from the fluid source and pump the treatment fluid through the heat exchanger 50 and on to the well head for injection into the formation.

For example, in one embodiment, the main fluid pump 94 is capable of supplying treatment fluid to the heat exchanger 50 at a pressure of about 150 psi. In a preferred embodiment, the main fluid pump 94 is also capable of drawing and pumping a maximum of 252 gpm of treatment fluid through the system 100. The requisite volumetric flow rate of treatment fluid is typically dictated by the particular operational requirements desired at the well head. By adjusting the speed of the main fluid pump 94, the volumetric flow rate of treatment fluid is controlled. The main fluid pump 94 is driven by a hydraulic motor 38 powered via supply line 35*a* by a hydraulic pump 35 attached to the accessory pump drive gear box 32. Consequently, the speed of the main fluid pump 94 is controlled by the operator using a control lever 12 to increase or decrease the amount of pressurized hydraulic fluid supplied to hydraulic motor 38. In a preferred embodiment, control lever 12 comprises an electronic joystick actuator, which regulates the displacement of the hydraulic pump to change the speed of its respective hydraulic motor. The hydraulic pressure depends on the loads placed on the hydraulic motors.

As the treatment fluid is pumped through the heat exchanger 50 contained within the firebox 40, the fluid is heated by the transfer of thermal energy generated by the combustion of a liquid-fuel/air mixture in the firebox 40. As previously detailed, pressurized primary air and liquid fuel are combined in the multiple burner assemblies 60, which each project an atomized fuel spay $F_A$ into the firebox 40 where it is combusted. The burner assemblies 60 are configured near the bottom of the firebox 40 and oriented so as to initially generate a substantially horizontal combustion flow 69 within the firebox 40. Pressurized secondary air assists in directing and controlling the thermal energy generated by the substantially horizontal combustion flow 69 to exhaust in a convective flow up and through the upper portion 53 of the heat exchanger 50.

The tubular coil heat exchanger 50 is designed to maximize the heat transfer of the thermal energy within the confines of the firebox 40. The heat exchanger 50 is, therefore, comprised of a tubular coil which is configured in a two interconnected portions, which are oriented along two distinct axes so as to maximize exposure to the heat generated by the oil-fired burner assemblies 60. The ambient or cool treatment fluid enters the heat exchanger 50 through the inlet 51 configured at or near the top of the heat exchanger coil 50. As the fluid flows through the upper portion 53 of the heat exchanger 50 thermal energy is transferred by the convective flow of the hot flue gases 88 over and between the stacked horizontal rows of interconnected adjacent tubes faked down in a series of reversing loops oriented about a vertical axis. As the fluid continues through the lower portion 56 of the heat exchanger 50 it flows through a helical coil oriented about a horizontal axis, thermal energy is transferred by the both the convective flow of the hot flue gases 88 and the radiant heat emanating from the substantially horizontal combustion flow 69 within the cavity/chamber or tunnel 65.

The convective flow of flue gases 88 through heat exchanger 50 is substantially enhanced by the secondary air system, which continually supplies large volumes of pressurized air to strategically configured vents 86, 87 on opposing sides of the firebox 40. The secondary air flow is essentially a forced air system which uses air as its heat transfer medium to extract thermal energy from the substantially horizontal combustion flow 69. The vents 86, 87 are positioned near the bottom of the closed-bottom firebox 40 and configured so that their respective airflows $F_B$, $F_C$ are generally directed into the cavity/chamber or tunnel 65 formed in the heat exchanger 50.

The treatment fluid continues to absorb thermal energy as it flows through the lower portion 56 of the heat exchanger 50 until it reaches the outlet 52 of the heat exchanger 50 where it is directed via tubular 95 and supply hose (not shown) to the well head for injection into the formation.

As the heated treatment fluid exits the outlet 52 of the heat exchanger 50 its temperature is monitored. The temperature of the treatment fluid exiting the heat exchanger outlet 52 is a function of three variables: the volumetric flow rate of the treatment fluid through the heat exchanger 50; the flow rate of the pressurized secondary air; and the heat generated by the multiple burner assemblies 60 configured in the heat exchanger 50. The flow rate of the secondary air is typically held constant during all operations while the volumetric flow rate of the treatment fluid is typically constant for a given operation. Thus, the temperature of the treatment fluid exiting the heat exchanger outlet 52 is controlled by regulating the volume of fuel supplied to the multiple burner assemblies 60.

In one embodiment, the operator monitors the temperature of the heated treatment fluid as it exits the outlet 52 of the heat exchanger 50. The operator then adjusts the temperature controller mechanism 68 sending a control signal to the fuel pressure control motor valve 27 to increase or decrease the volume of fuel supplied to the multiple burner assemblies 60 via pressurized metered fuel lines 28. The control signal may comprise an electrical, wireless, pneumatic, or hydraulic signal. For example, in the depicted embodiment, the adjustable temperature controller mechanism 68 comprises a simple manual rotary valve, which controls the pneumatic pressure supplied to the fuel pressure control motor valve 27.

In another embodiment, the temperature controller mechanism 68 is an automated thermostat mechanism that continually monitors the temperature of the treatment fluid exiting the heat exchanger outlet 52. An operator inputs a desired temperature reading (i.e., set point temperature), The temperature controller mechanism 68 compares the actual temperature of the treatment fluid exiting the heat exchanger outlet 52 with the set point temperature and automatically adjusts the control signal supplied to the fuel pressure control motor valve 27. For example, if the temperature of the treatment fluid exiting the heat exchanger outlet 52 is less than the set point temperature, the temperature controller mechanism 68 adjusts the control signal supplied to the fuel pressure control motor valve 27 to increase the volume of fuel supplied to the multiple burner assemblies 60 via pressurized metered fuel lines 28 in order to maintain a set point temperature. Conversely, if the temperature of the treatment fluid exiting the heat exchanger outlet 52 is higher than the set point temperature, the temperature controller mechanism 68 adjusts the control signal supplied to the fuel pressure control motor valve 27 to decrease the volume of fuel supplied to the multiple burner assemblies 60 via pressurized metered fuel lines 28 in order to maintain a set point temperature.

The temperature of the treatment fluid is also typically monitored at the inlet 51 of the heat exchanger 50. The temperature spread between the inlet 51 and outlet 52 of the heat exchanger 50, when combined with the volumetric flow rate of treatment fluid, is indicative of the heating capacity of the system. Field testing has determined that the depicted embodiment of the oil-fired heat exchanger system 100 of the present invention is capable of heating ambient water from 70° F. to 210° F. at a maximum volumetric flow rate of 252 gpm. Moreover, field reports further indicate that the system 100 is capable of heating water from 40° F. to 210° F. in ambient atmospheric temperatures below 25° F. at a slightly reduced volumetric flow rate (e.g., 200-250 gpm).

It will now be evident to those skilled in the art that there has been described herein an improved heat exchanger system for heating large, continuously flowing volumes of treatment fluids at remote locations. Although the invention hereof has been described by way of a preferred embodiment, it will be evident that other adaptations and modifications can be employed without departing from the spirit and scope thereof. For example, instead of the treatment fluid being water, it could be a petroleum based liquid such as oil for hot oil well treatments. The terms and expressions employed herein have been used as terms of description and not of limitation; and thus, there is no intent of excluding equivalents, but on the contrary it is intended to cover any and all equivalents that may be employed without departing from the spirit and scope of the invention.

I claim:

1. A portable system for heating treatment fluids at a remote work site, comprising:

a closed-bottom firebox having an exhaust stack configured near the top of said firebox;

a heat exchanger contained within said firebox, said heat exchanger comprising a tubular coil having a single inlet and a single outlet, wherein said tubular coil includes an upper portion oriented about a first axis and a lower portion oriented about a second axis, said lower portion comprising a helical coil oriented about a horizontal axis so as to define a chamber for receiving a substantially horizontal combustion flow, said chamber being substantially enclosed by said helical tubular coil on all but one opened side;

a fluid supply system including a fluid supply pump connected to said inlet of said tubular coil;

three or more burner assemblies configured in said firebox, each of said burner assemblies comprising a nozzle that projects an atomized fuel-air spray into said chamber though said opened side, which when combusted results in a substantially horizontal combustion flow into said chamber, a primary air system for supplying a first pressurized air flow to each of said burner assemblies, wherein said primary air system comprises a blower pump fluidly connected to a primary air inlet of each of said plurality of burner assemblies, said blower pump comprising a positive displacement rotary blower; and a secondary air system for supplying a second pressurized air flow to said firebox, wherein said helical tubular coil includes a plurality of traversing lateral tubes which substantially enclose said chamber on side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through said heat exchanger by said supply pump.

2. The system of claim 1, wherein said inlet is configured substantially near the top of the heat exchanger and said outlet is configured substantially near the bottom of the heat exchanger to minimize back pressure on said fluid supply pump.

3. The system of claim 1, wherein said upper portion comprises a plurality of stacked horizontal rows of tubing faked down in a series of reversing loops oriented about a vertical axis.

4. The system of claim 1, wherein said primary air system further comprises an intake air filter in fluid communication with said blower pump.

5. The system of claim 1, wherein said primary air system further comprises an air silencer mechanism in fluid communication with said blower pump and said plurality of burner assemblies.

6. The system of claim 1, wherein said secondary air system comprises a plurality of centrifugal fan mechanisms aligned in a parallel configuration and having a common driveshaft, wherein each of said plurality of centrifugal tin mechanisms includes a housing in fluid communication with ductwork that is fluidly connected to a plurality of vents in said firebox.

7. The system of claim 6, wherein said blower pump is rotatively coupled to said driveshaft.

8. The system of claim 7, wherein the blower pump and said plurality of centrifugal fan mechanisms are powered by a motor attached to said driveshaft.

9. The system of claim 8, wherein said motor is hydraulically powered.

10. The system of claim 1, wherein said plurality of burner assemblies comprises a first and second set of burner assemblies, wherein each set comprises more than one burner assembly;

said primary air system comprises a first primary blower system which includes a first blower pump fluidly connected to a primary air inlet of each of said first set of burner assemblies, and a second primary blower system which includes a second blower pump fluidly connected to a primary air inlet of each of said second set of burner assemblies;

said secondary air system comprises a first secondary blower system which includes a first plurality of centrifugal fan mechanisms aligned in a parallel configuration and having a common first driveshaft, wherein each of said first plurality of centrifugal fan mechanisms includes a housing in fluid communication with a first ductwork that is fluidly connected to a first plurality of vents in said firebox, and a second secondary blower system which includes a second plurality of centrifugal fan mechanisms aligned in a parallel configuration and having a common second driveshaft, wherein each of said second plurality of centrifugal fan mechanisms includes a housing in fluid communication with a second ductwork that is fluidly connected to a second plurality of vents in said firebox;

wherein said first blower pump is rotatively coupled to said first driveshaft and said second blower pump is rotatively coupled to said second driveshaft.

11. The system of claim 10, wherein said first blower pump and said first plurality of centrifugal fan mechanisms are powered by first motor rotatively coupled to said first driveshaft; and said second blower pump and said second plurality of centrifugal fan mechanisms are powered by second motor rotatively coupled to said second driveshaft.

12. A system of claim 1, further comprising a fuel supply system, which includes a fuel pressure control motor valve that controls the volume of pressurized fuel supplied to each set of burner assemblies.

13. The system of claim 12, wherein said fuel pressure control motor valve is pneumatically actuated.

14. The system of claim 12, further comprising a temperature controller mechanism, which controls the temperature of the treatment fluid exiting said heat exchanger outlet by adjusting a control signal to said fuel pressure control motor valve to increase or decrease the volume of pressurized fuel supplied to each set of burner assemblies.

15. The system of claim 14, wherein said temperature controller mechanism automatically adjusts said control signal in response to a comparison between the temperature of the treatment fluid exiting said heat exchanger outlet and a set point temperature setting on said temperature controller mechanism.

16. The system of claim 15, wherein said temperature controller mechanism senses the temperature of said treatment fluid at said heat exchanger outlet, compares said temperature to a set-point temperature, and adjusts said control signal to said fuel pressure control motor valve to increase or decrease the volume of pressurized fuel supplied to each set of burner assemblies so that said temperature will equal said set-point temperature.

17. The system of claim 1, further including a hood door assembly, which comprises a first door, which is pivotally mounted to one side of said exhaust stack; and a second door, which is pivotally mounted to an opposing side of said exhaust stack.

18. The system of claim 17, further including a mechanism for opening said hood door assembly, comprising a piston having a one end pivotally attached to a side of said firebox and a piston rod protruding from an opposing end;

a first bell crank pivotally attached to said piston rod and having a first pivot point, which is pivotally attached to a tapered hood assembly;

a first pushrod linkage having one end pivotally attached to said first bell crank;

a second bell crank, which is pivotally attached to an opposing end of said first pushrod linkage, and fixably attached said first door, said second bell crank having a second pivot point, Which is co-aligned with said pivotal mount of said first door;

a second pushrod linkage having one end pivotally attached to said second bell crank;

a third bell crank which is pivotally attached to an opposing end of said second pushrod linkage, and fixably attached said second door, said third bell crank having a third pivot point, which is co-aligned with said pivotal mount of said second door;

wherein, when said piston is actuated, said piston rod extends from said piston simultaneously causing said first and second doors to pivot open.

19. The system of claim 18, wherein said piston is a pneumatic piston.

20. The system of claim 1, wherein said fluid supply pump comprises a hydraulically-powered centrifugal fluid pump.

21. A portable system for heating treatment fluids at a remote work site, comprising:

a closed-bottom firebox having an exhaust stack configured near the top of said firebox;

a heat exchanger contained within said firebox, said heat exchanger comprising a tubular coil having a single inlet and a single outlet, wherein said tubular coil includes an upper portion oriented about a first axis and a lower portion oriented about a second axis, said lower portion comprising a helical coil oriented about a horizontal axis so as to define a chamber for receiving a substantially horizontal combustion flow, said chamber being substantially enclosed by said helical tubular coil on all but one opened side;

a fluid supply system including a fluid supply pump connected to said inlet of said tubular coil;

three or more burner assemblies configured in said firebox, each of said burner assemblies comprising a nozzle that projects an atomized fuel-air spray into said chamber though said opened side, which when combusted results in a substantially horizontal combustion flow into said chamber, a primary air system for supplying a first pressurized air flow to each of said burner assemblies, wherein said primary air system comprises a blower pump fluidly connected to a primary air inlet of each of said plurality of burner assemblies, and an intake air filter in fluid communication with said blower pump; and a secondary air system for supplying a second pressurized air flow to said firebox, wherein said helical tubular coil includes a plurality of traversing lateral tubes which substantially enclose said chamber on side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through said heat exchanger by said supply pump.

22. A portable system for heating treatment fluids at a remote work site, comprising:

a closed-bottom firebox having an exhaust stack configured near the top of said firebox;

a heat exchanger contained within said firebox, said heat exchanger comprising a tubular coil having a single inlet and a single outlet, wherein said tubular coil includes an upper portion oriented about a first axis and a lower portion oriented about a second axis, said lower portion comprising a helical coil oriented about a horizontal axis so as to define a chamber for receiving a substantially horizontal combustion flow, said chamber being substantially enclosed by said helical tubular coil on all but one opened side;

a fluid supply system including a fluid supply pump connected to said inlet of said tubular coil;

three or more burner assemblies configured in said firebox, each of said burner assemblies comprising a nozzle that projects an atomized fuel-air spray into said chamber though said opened side, which when combusted results in a substantially horizontal combustion flow into said chamber, a primary air system for supplying a first pressurized air flow to each of said burner assemblies, wherein said primary air system comprises a blower pump fluidly connected to a primary air inlet of each of said plurality of burner assemblies, and an air silencer mechanism in fluid communication with said blower pump and said plurality of burner assemblies; and a secondary air system for supplying a second pressurized air flow to said firebox, wherein said helical tubular coil includes a plurality of traversing lateral tubes which substantially enclose said chamber on side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through said heat exchanger by said supply pump.

* * * * *